US011506403B2

(12) United States Patent
Yamauchi et al.

(10) Patent No.: US 11,506,403 B2
(45) Date of Patent: Nov. 22, 2022

(54) OUTDOOR UNIT FOR AIR-CONDITIONING APPARATUS

(71) Applicant: Mitsubishi Electric Corporation, Tokyo (JP)

(72) Inventors: Hidetaka Yamauchi, Tokyo (JP); Kazuho Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 198 days.

(21) Appl. No.: 16/981,807

(22) PCT Filed: May 8, 2018

(86) PCT No.: PCT/JP2018/017699
§ 371 (c)(1),
(2) Date: Sep. 17, 2020

(87) PCT Pub. No.: WO2019/215803
PCT Pub. Date: Nov. 14, 2019

(65) Prior Publication Data
US 2021/0041117 A1 Feb. 11, 2021

(51) Int. Cl.
*F24F 1/58* (2011.01)
*F24F 1/14* (2011.01)

(52) U.S. Cl.
CPC . *F24F 1/58* (2013.01); *F24F 1/14* (2013.01)

(58) Field of Classification Search
CPC ..... F24F 1/58; F24F 1/56; F24F 1/14; F24F 13/084; F24F 2221/52
See application file for complete search history.

(56) References Cited

U.S. PATENT DOCUMENTS

2013/0055748 A1* 3/2013 Mahajan ..... F04D 29/582 62/262

FOREIGN PATENT DOCUMENTS

| | | | |
|---|---|---|---|
| EP | 3147582 | A1 * | 3/2017 |
| JP | S63-108036 | U | 7/1988 |
| JP | H08-247097 | A | 9/1996 |
| JP | H09-060927 | A | 3/1997 |
| JP | 2010-175195 | A | 8/2010 |

(Continued)

OTHER PUBLICATIONS

Machine translation of EP 3147582 (Year: 2017).*

(Continued)

*Primary Examiner* — Joseph F Trpisovsky
(74) *Attorney, Agent, or Firm* — Posz Law Group, PLC

(57) ABSTRACT

Provided is an outdoor unit for an air-conditioning apparatus having high reliability. A protective net disposed over an air inlet at a rear surface of a casing includes a frame body defining an outer periphery of the protective net, and a plurality of vertical bars and a plurality of horizontal bars crossing each other inside the frame body and defining a plurality of ventilation openings. Each horizontal bar has an upper surface having a downwardly open V-shape in vertical cross-section formed by combining a rear upper surface inclined downward and rearward and a front upper surfaced inclined downward and forward. When it snows, snow on the horizontal bar slides off a downward slope without freezing into ice on the horizontal bar. Accordingly, a reduction in an opening area of the ventilation openings due to ice does not occur.

9 Claims, 20 Drawing Sheets

(56) References Cited

FOREIGN PATENT DOCUMENTS

| | | | |
|---|---|---|---|
| JP | 2012-112629 | A | 6/2012 |
| KR | 2000-0020418 | A | 4/2000 |

OTHER PUBLICATIONS

International Search Report of the International Searching Authority dated Jul. 31, 2018 for the corresponding International application No. PCT/JP2018/017699 (and English translation).
Extended European Search dated Apr. 19, 2021, issued in corresponding European Patent Application No. 18918017.7.

* cited by examiner

OUTDOOR UNIT FOR AIR-CONDITIONING APPARATUS

CROSS REFERENCE TO RELATED APPLICATION

This application is a U.S. national stage application of PCT/JP2018/017699 filed on May 8, 2018, the contents of which are incorporated herein by reference.

TECHNICAL FIELD

The present disclosure relates to an outdoor unit for an air-conditioning apparatus, and particularly relates to a protective net disposed over the rear surface of an outdoor heat exchanger to protect the outdoor heat exchanger.

BACKGROUND ART

An outdoor unit for an air-conditioning apparatus has a casing with its inner space divided into two spaces in the lateral direction by a partition wall standing upright on the bottom plate. One of the spaces is used as a fan chamber in which an outdoor heat exchanger and an air-sending fan are disposed, and the other space is used as a machine chamber in which a compressor and an electrical component unit including a control board are disposed.

The outdoor heat exchanger is bent in an arcuate form at substantially 90 degrees at a bent portion in the middle to have a substantially L-shape in plan view. A long side portion corresponding to the long side of the L-shape is located close to the rear surface of the fan chamber, and a short side portion corresponding to the short side is located close to the side surface of the fan chamber on the side opposite to the machine chamber in the lateral direction. The bent portion is located between the long side portion and the short side portion, at the corner of the fan chamber. The outer surface (rear surface) of the long side portion of the outdoor heat exchanger is exposed outside. To protect the exposed portion, a protective net having a plurality of ventilation openings defined by a plurality of vertical bars and a plurality of horizontal bars crossing each other is attached to the rear of the outdoor unit (see, for example, Patent Literature 1).

CITATION LIST

Patent Literature

Patent Literature 1: Japanese Unexamined Patent Application Publication No. 2012-112629 (paragraph 0005, FIGS. 6 and 7)

SUMMARY OF INVENTION

Technical Problem

In recent years, heat-pump air-conditioning apparatuses have become commonly used in cold districts because of an improvement in heating capacity. Some heat-pump air-conditioning apparatuses are used even in cold districts where the outdoor air temperature reaches 0 degrees C. or below during winter. In the case of an outdoor unit installed outdoors in a cold district, when it snows in winter, snow accumulates on the horizontal bars of a protective net, and the accumulated snow may freeze into ice on the horizontal bars. When freezing starts, more snow accumulates on a block of ice, and the block of ice becomes huge.

A block of ice reduces the opening area of the ventilation openings of a protective net, which reduces the flow rate of the air flowing toward an outdoor heat exchanger through the ventilation openings. Accordingly, the heat exchange amount of the refrigerant in the outdoor heat exchanger is reduced, so that the heating performance is reduced.

The present disclosure has been made to solve the above problems, and an object of the present disclosure is to provide an outdoor unit for an air-conditioning apparatus capable of preventing snow from freezing on horizontal bars of a protective net when it snows, and preventing a reduction in the flow rate of the air passing through ventilation openings of the protective net.

Solution to Problem

An outdoor unit for an air-conditioning apparatus according to an embodiment of the present disclosure includes a casing having an air inlet formed at a rear surface of the casing, an outdoor heat exchanger disposed in the casing in such a manner that at least a part of the outdoor heat exchanger faces the air inlet, and a protective net having a plurality of ventilation openings and disposed over the air inlet. The protective net includes a frame body defining an outer periphery of the protective net, and a plurality of vertical bars and a plurality of horizontal bars crossing each other inside the frame body and defining the plurality of ventilation openings. Each of the plurality of horizontal bars has an upper surface having a downwardly open V-shape in vertical cross-section formed by combining a rear upper surface inclined downward and rearward and a front upper surface inclined downward and forward.

Advantageous Effects of Invention

According to an embodiment of the present disclosure, it is possible to provide an outdoor unit for an air-conditioning apparatus capable of preventing snow from freezing on horizontal bars of a protective net when it snows, and preventing a reduction in the flow rate of the air passing through ventilation openings of the protective net.

DESCRIPTION OF EMBODIMENTS

Embodiment 1

Figure 1:
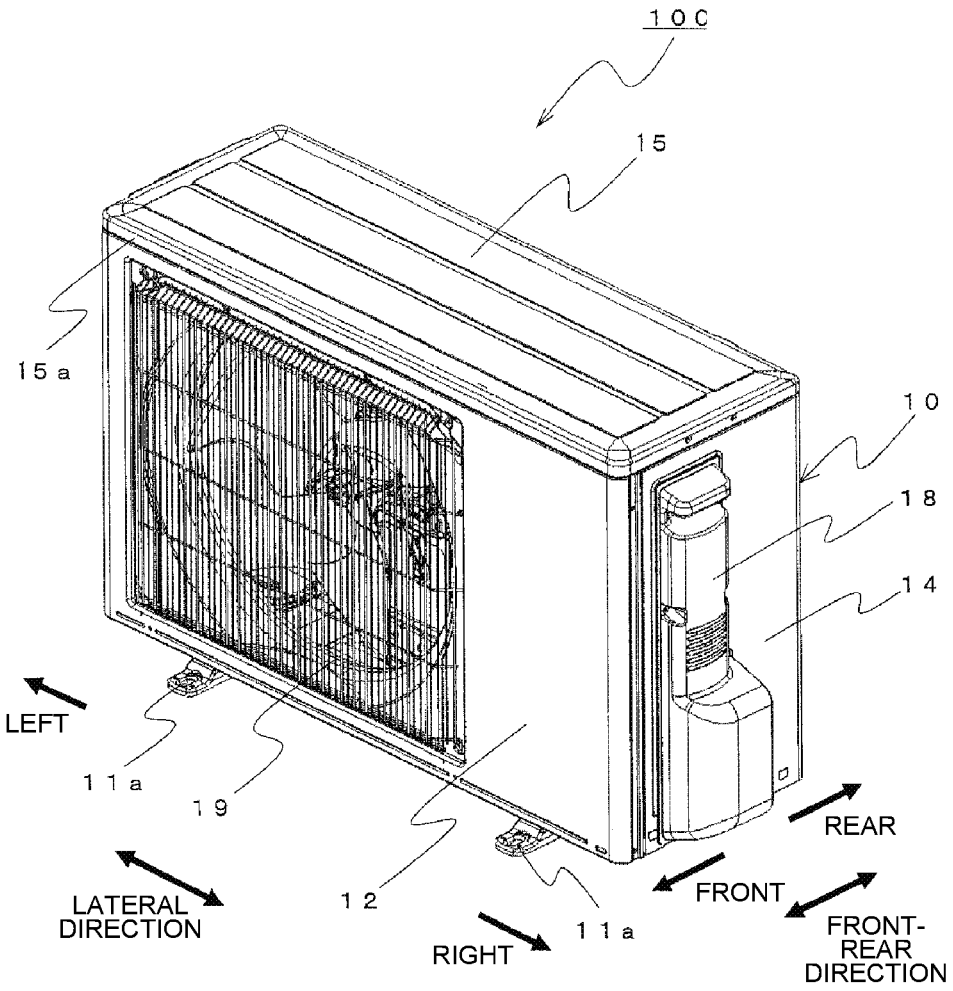
FIG. 1 is an external perspective view of an outdoor unit for an air-conditioning apparatus as viewed from the front, according to Embodiment 1 of the present disclosure.
Figure 2:
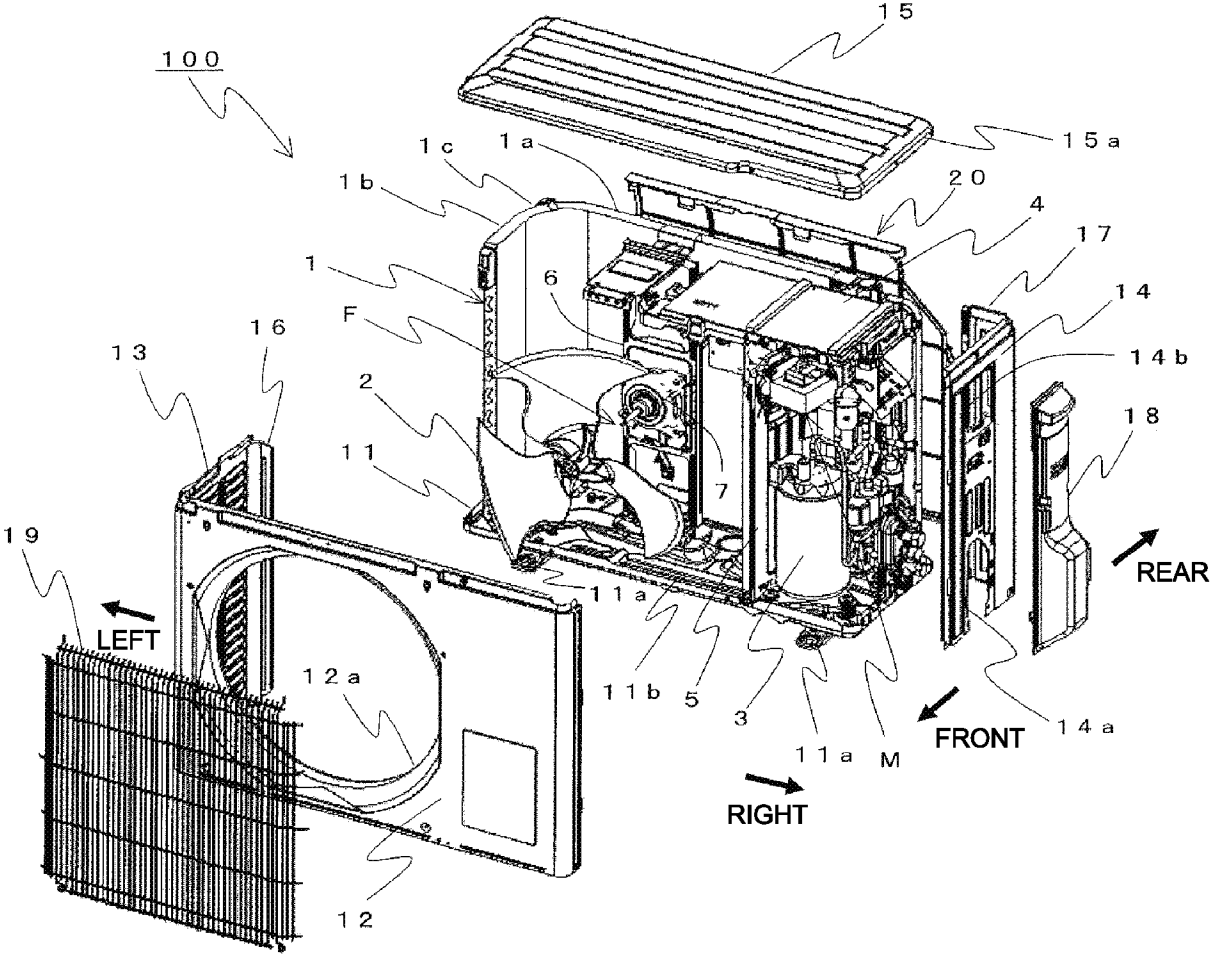
FIG. 2 is an exploded perspective view of the outdoor unit illustrated in FIG. 1.
Figure 3:
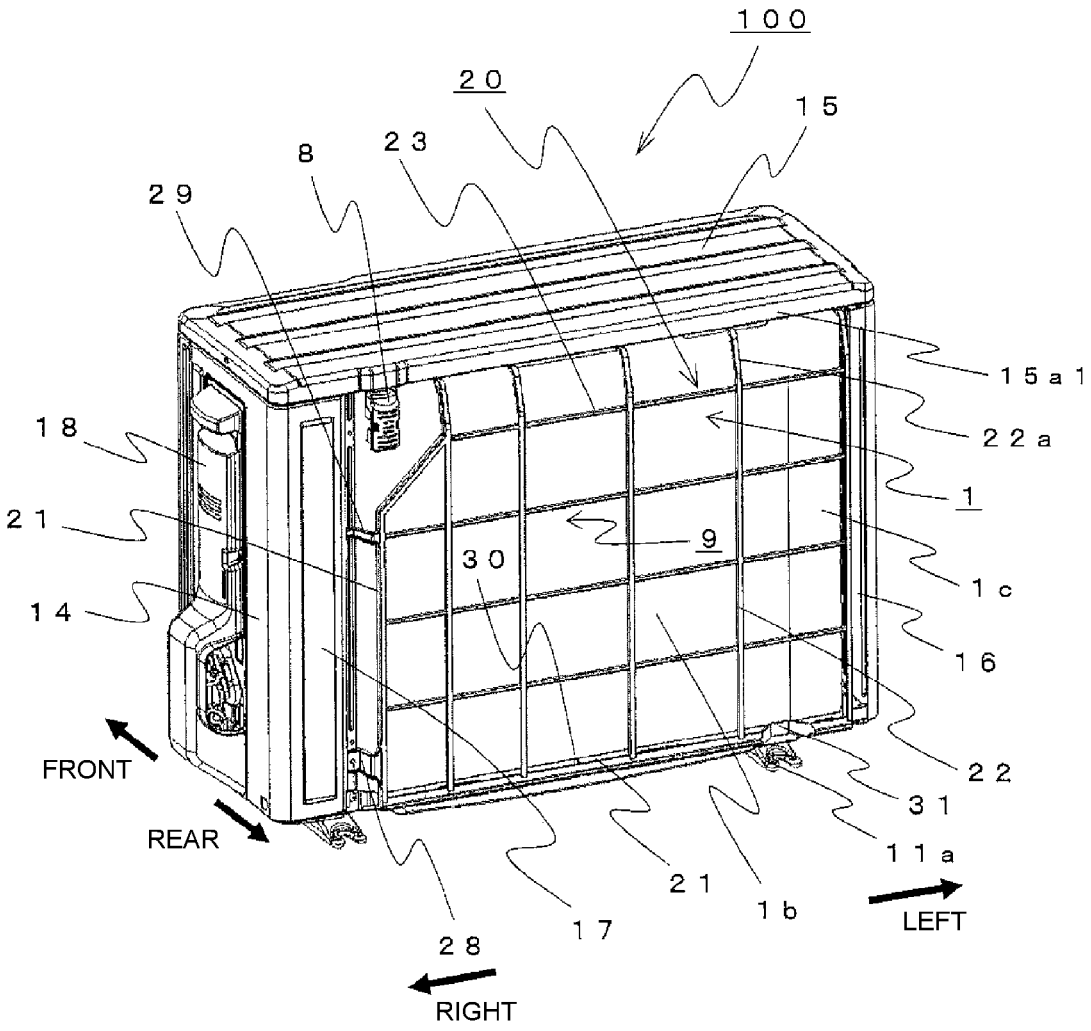
FIG. 3 is an external perspective view of the outdoor unit illustrated in FIG. 1, as viewed from the rear.

Hereinafter, Embodiment 1 of the present disclosure will be described with reference to the drawings. FIG. 1 is an external perspective view of an outdoor unit 100 for an air-conditioning apparatus (hereinafter referred to as an outdoor unit 100) as viewed from the front, according to Embodiment 1 of the present disclosure, and FIG. 2 is an exploded perspective view of the outdoor unit 100. FIG. 3 is an external perspective view of the outdoor unit 100, as viewed from the rear. This outdoor unit is installed outdoors, and is connected with a refrigerant pipe to an indoor unit, which is not illustrated, installed indoors, thereby forming a refrigeration cycle. The outdoor unit 100 and the indoor unit form a separate-type air-conditioning apparatus.

The outdoor unit 100 has the appearance of a cuboid that is longer in the lateral direction than in the front-rear direction. As illustrated in FIG. 2, the inner space of a casing 10 is divided by a partition plate 5 into two spaces in the lateral direction. One of the spaces is used as a fan chamber F in which an outdoor heat exchanger 1 and an air-sending fan 2 are disposed, and the other space is used as a machine chamber M in which a compressor 3 and an electrical component unit 4 including a control board are disposed.

The casing 10 is formed by a plurality of sheet metal parts. The sheet metal parts include a bottom plate 11 defining the bottom surface, a front panel 12 covering the front, a left side panel 13 and a right side panel 14 covering the respective left and right side surfaces, a top panel 15 covering the upper surface, a left rear panel 16 covering the rear surface of the left end of the fan chamber F, in other words, the end of the fan chamber F on the side opposite to the machine chamber M, and a right rear panel 17 covering the rear surface of the machine chamber M. In this outdoor unit 100, the left side panel 13 and the left rear panel 16 are formed integrally with the front panel 12. Further, the right rear panel 17 is formed integrally with the right side panel 14. A pair of legs 11*a* supporting the outdoor unit 100 is fixed to the lower surface of the bottom plate 11. Each leg 11*a* extends across the bottom plate 11 in the front-rear direction in such a manner that the front end is disposed further front than the bottom plate 11, and the rear end is disposed further rear than the bottom plate 11.

The four edges around the bottom plate 11 having a rectangular shape in plan view are continuously bent upward to form a bottom flange 11*b*. Further, the four edges around the top panel 15 also having a rectangular shape in plan view are continuously bent downward to form an upper flange 15*a*. A rear bottom flange 11*b*1 is one of the four sides of the bottom flange 11*b* that extends in the lateral direction and that is disposed rearmost. Similarly, a rear upper flange 15*a*1 is one of the four sides of the upper flange 15*a* that extends in the lateral direction and that is disposed rearmost. The rear surface of the casing 10 has a rectangular opening defined by the rear upper flange 15*a*1 of the top panel 15, the left rear panel 16, the right rear panel 17, and the rear bottom flange 11*b*1 of the bottom plate 11. This opening is used as an air inlet 9 for the air flow.

In description of Embodiments, as illustrated in FIG. 1, the direction in which the front panel 12 is disposed is defined as the front side, and the direction opposite to the front side is defined as the rear side. The direction connecting the front side and the rear side is referred to as the front-rear direction. The front side is referred to also as front or forward, and the rear side is referred to also as rearward. The direction in which the machine chamber M is disposed when the outdoor unit 100 is viewed from the front is referred to as the right side, the direction in which the fan chamber F is disposed is referred to as the left side, and the direction connecting the right and left sides are referred to as the lateral direction.

In the machine chamber M, the compressor 3 is installed on the bottom plate 11 with an anti-vibration rubber interposed between the compressor 3 and the bottom plate 11, and the electrical component unit 4 is disposed at the upper part of the machine chamber M. The right side panel 14 facing the machine chamber M has a notch 14*a* that allows a connection valve to project rightward through the right side panel 14 and to be connected to a connection pipe for connection with the indoor unit, and an opening 14*b* that allows a power line and a signal line from the indoor unit to pass through the right side panel 14 to the inside of the machine chamber M. A side cover 18 provided as a separate part that covers the notch 14*a* and the opening 14*b* is attached to the right side panel 14.

The outdoor heat exchanger 1 and the air-sending fan 2 are disposed in the fan chamber F in the casing 10. The outdoor heat exchanger 1 is bent in an arcuate form at substantially 90 degrees at a bent portion 1*c* in the middle to have a substantially L-shape in plan view, and is disposed on the bottom plate 11. A long side portion 1*a* corresponding to the long side of the L-shape is disposed close to the rear surface of the fan chamber F, and a short side portion 1*b* corresponding to the short side is disposed close to the left side surface of the fan chamber F, that is, the side surface opposite to the machine chamber M. The bent portion 1*c* between the long side portion 1*a* and the short side portion 1*b* is disposed at the rear left corner of the fan chamber F, that is, the rear corner of the side surface opposite to the machine chamber M. The long side portion 1*a* is parallel to the rear bottom flange 11*b*1 of the bottom plate 11 and a rear upper flange 11*a*1 of the top panel 15, while the short side portion 1*b* is parallel to the left side panel 16.

The outdoor heat exchanger 1 is of a fin-and-tube type, and includes thin plate-shaped fins arranged in parallel in the horizontal direction to be parallel to each other, and a metal heat transfer pipe bent into a plurality of turns in the vertical direction while extending through the fins. The fins are made of aluminum, and the heat transfer tube is a copper pipe. The outdoor heat exchanger 1 is formed by bending a straight heat exchanger into an arcuate form at the bent portion 1*c* to have a substantially L-shape in plan view.

The air-sending fan 2 is an axial fan. The air-sending fan 2 is connected to a fan motor 7 supported by a fan motor support 6, and is disposed on the front side of the long side portion 1*a* of the outdoor heat exchanger 1. The front panel 12 disposed on the front side of the air-sending fan 2 has an air outlet 12*a* facing the air-sending fan 7. The air outlet 12*a* is provided with a fan guard 19 for preventing foreign matter from coming into contact with the rotating air-sending fan 7.

As illustrated in FIG. 3, a part of the outdoor heat exchanger 1 is exposed outside through the air inlet 9 formed at the rear surface of the casing 10, on the rear side of the outdoor unit 100. The outdoor heat exchanger 1 is disposed in the casing 10 in such a manner that the long side portion 1*a* and a part of the bent portion 1*c* continuous to the long side portion 1*a* face the air inlet 9. Further, a protective net 20 for protecting the outdoor heat exchanger 1 is disposed over the air inlet 9 at the rear surface of the casing 10. The protective net 20 is disposed on the rear side of a portion of the outdoor heat exchanger 1 facing the air inlet 9. The following describes the details of the protective net 20.

Figure 4:
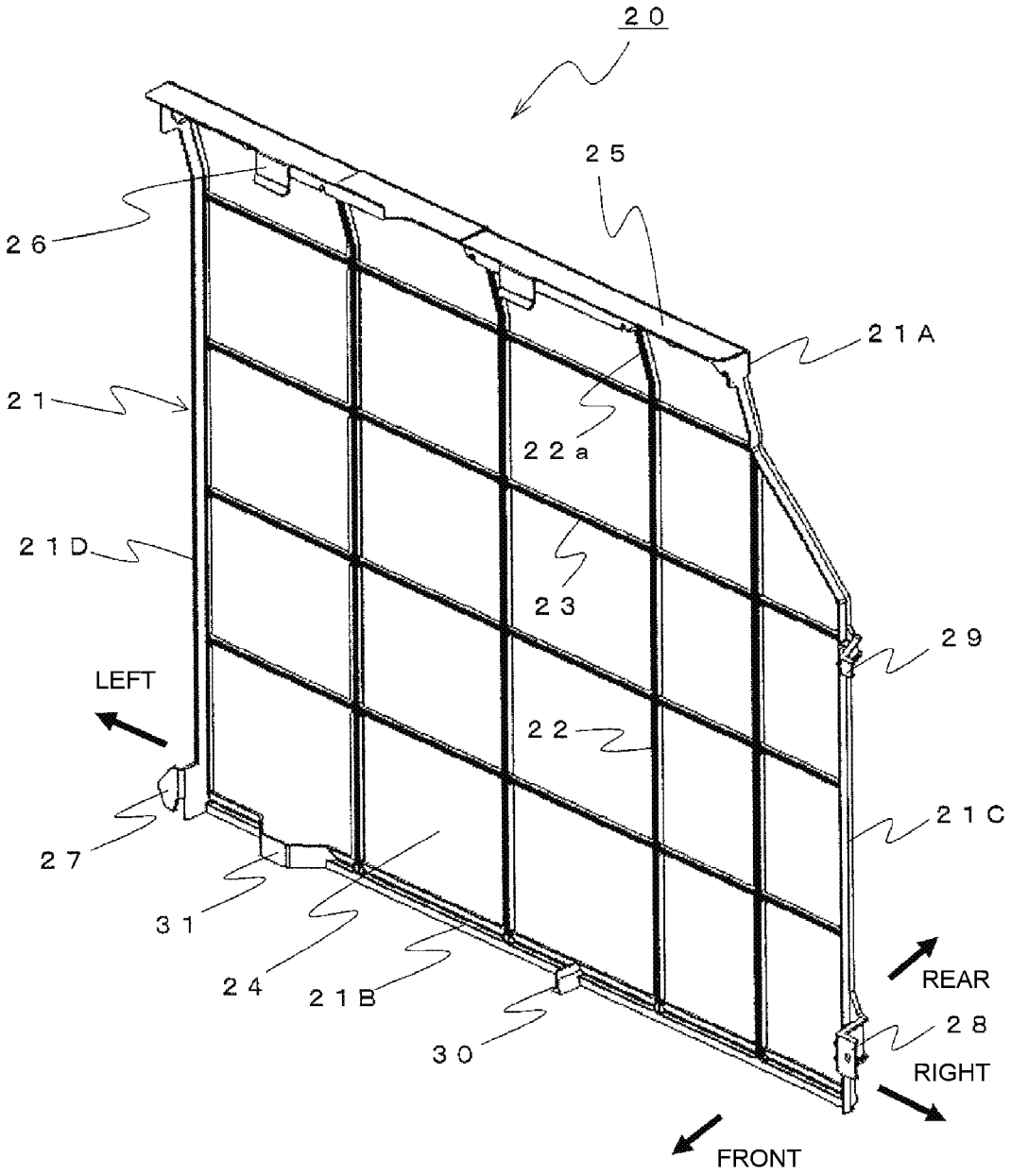
FIG. 4 is a perspective view of only a protective net of the outdoor unit illustrated in FIG. 1.

FIG. 4 is a perspective view of only the protective net 20 as viewed from the front, illustrating the surface facing the outdoor heat exchanger 1. The protective net 20 is integrally molded with a resin material, and includes a frame body 21 defining the outer periphery of the protective net 20, and a plurality of vertical bars 22 and a plurality of horizontal bars 23 crossing each other inside the frame body 21. A machine-chamber-side frame 21C of the frame body 21 is partly inclined in the lateral direction to avoid an outside air temperature detector 8 disposed at the rear upper part of the outdoor unit 100 (see FIG. 3). The frame body 21 is attached to the rear surface of the outdoor unit 100 in such a manner that the machine-chamber-side frame 21C excluding the inclined portion and a non-machine-chamber-side frame 21*d* are parallel to the vertical direction of the outdoor unit 100, and in such a manner that an upper frame 21A and a lower frame 21B are parallel to the lateral direction of the outdoor unit 100.

The outside air temperature detector 8 includes a thermistor thermometer stored in a resin case that allows air to flow through in the front-rear direction, and is disposed on the rear side of the outdoor heat exchanger 1, that is, upstream of the outdoor heat exchanger 1 in the air flow to detect the temperature of the air flow that is to pass through the outdoor heat exchanger 1.

The vertical bars 22 are parallel to the non-machine-chamber-side frame 21D of the frame body 21, and extend between the upper frame 21A and the lower frame 21B. The horizontal bars 23 are parallel to the lower frame 21B, and extend between the machine-chamber-side frame 21C and the non-machine-chamber-side frame 21D. Therefore, the vertical bars 22 and the horizontal bars 23 extend orthogonal to each other, thereby defining a plurality of ventilation openings 24 in a lattice form inside the frame body 21. Note that the machine-chamber-side frame 21C and the non-machine-chamber-side frame 21D of the frame body 21 are referred to as a pair of vertical frames. Each of the pair of vertical frames connects the corresponding one of the lateral ends of the upper frame 21A to the corresponding one of the lateral ends of the lower frame 21B in the vertical direction.

During a cooling operation of or a heating operation of the air-conditioning apparatus, the air-sending fan 2 rotates to generate an air flow that passes through the outdoor unit 100. The air flow passes through the outdoor heat exchanger 1. The air flow that passes through the long side portion 1*a* and a part of the bent portion 1*c* passes through the outdoor heat exchanger 1, after passing through the plurality of ventilation openings 24 of the protective net 20. That is, this air flow is directed forward from the rear side, and the protective net 20 is disposed upstream of the outdoor heat exchanger 1 in this air flow. When passing through the outdoor heat exchanger 1, the air flow exchanges heat with refrigerant flowing through the heat transfer pipe of the outdoor heat exchanger 1. The refrigerant circulates in a refrigeration cycle because of the action of the compressor 3. The air flow that has exchanged heat with the refrigerant passes through the air-sending fan 2 to flow out of the outdoor unit 100 through the air outlet 12*a*.

Figure 5:
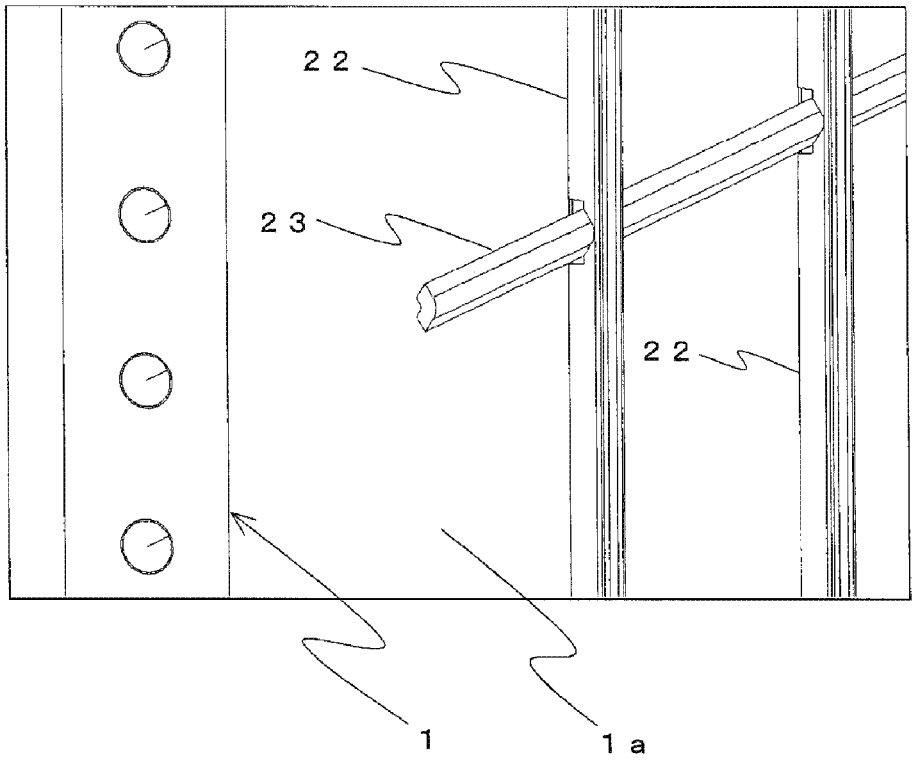
FIG. 5 is a cross-sectional perspective view illustrating a vertical cross-section of a horizontal bar of the protective net illustrated in FIG. 4.
Figure 6:
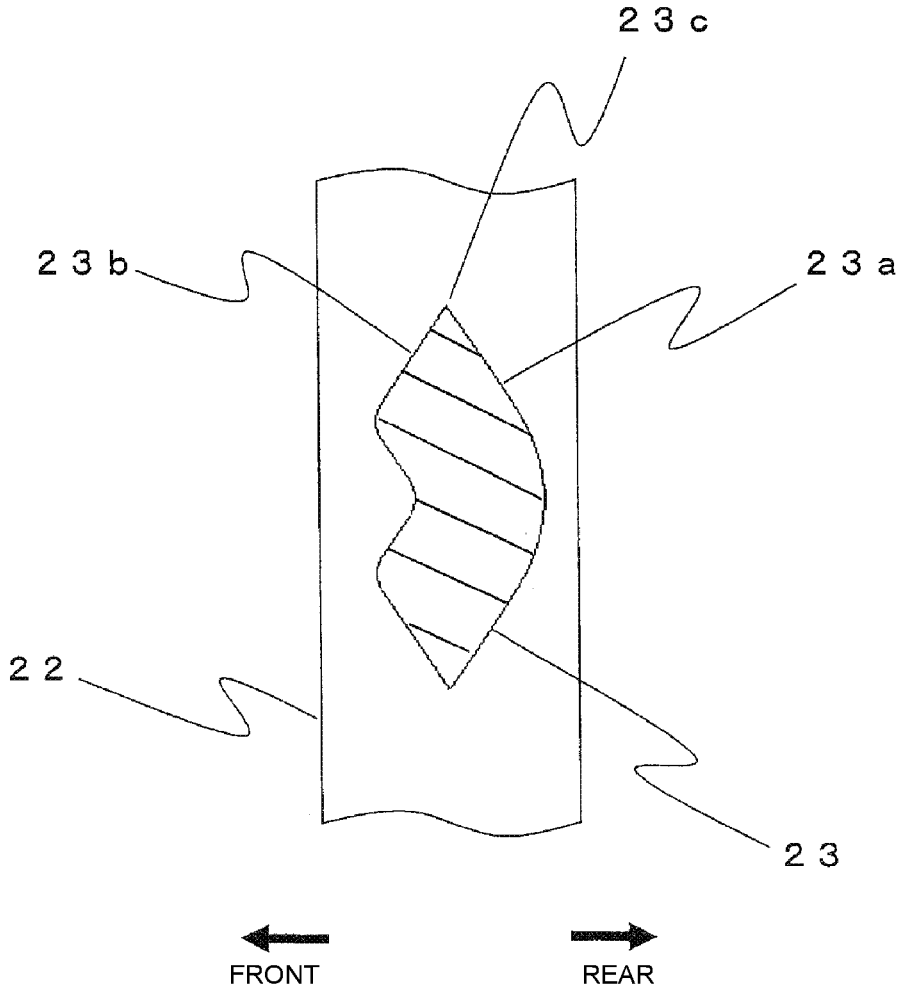
FIG. 6 is a vertical cross-sectional view of the horizontal bar of the protective net illustrated in FIG. 4.

FIG. 5 is a cross-sectional perspective view illustrating a vertical cross-section of the horizontal bar 23 of the protective net 20. FIG. 6 is a vertical cross-sectional view of the horizontal bar 23. As illustrated in FIG. 6, the upper surface of the horizontal bar 23 is not flat, but has a downwardly open V-shape, in other words, a Λ (lambda) shape, in vertical cross-section. A rear upper surface 23*a* is a surface inclined downward from the front side to the rear side, while a front upper surface 23*b* is a surface inclined downward from the rear side to the front side. The rear upper surface 23*a* and the front upper surface 23*b* inclined in the opposite directions have their upper ends connected to each other at an acute angle at a connection portion 23*c*.

The protective net 20 has the horizontal bars 23 each having an upper surface formed to have a downwardly open V-shape (referred to also as an inverted V-shape) in cross-section by combining two inclined surfaces, namely, the rear upper surface 23*a* inclined downward and rearward and the front upper surface 23*b* inclined downward and forward. Therefore, when it snows, the snow on each horizontal bar 23 slides off the downward slope of the rear upper surface 23*a* or the front upper surface 23*b*. Accordingly, the snow on the horizontal bars 23 does not stay on the horizontal bars 23, so that snow does not accumulates on the horizontal bars 23.

In this manner, as the protective net 20 has the horizontal bars 23 each having an inclined upper surface having a downwardly open V-shape, snow does not accumulate on the horizontal bars 23 even when it snows. Therefore, snow does not freeze on the horizontal bars 23. This prevents a reduction in the opening area of the ventilation openings 24 due to ice, and therefore prevents a reduction in the flow rate of the air flowing toward the outdoor heat exchanger 1 through the ventilation openings 24. Accordingly, the heat exchange amount of the refrigerant in the outdoor heat exchanger 1 is prevented from decreasing, and therefore the heating performance is prevented from decreasing.

Also, snow does not freeze on the horizontal bars 23, which prevents a situation where the snow on the horizontal bars 23 freezes into a block of ice, and the block of ice grows huge and comes into contact with the outdoor heat exchanger 1. This prevents the fins of the outdoor heat exchanger 1 from being deformed to reduce or block the clearances between the fins through which air flows, and therefore prevents a reduction in the flow rate of the air passing through the outdoor heat exchanger 1. Accordingly, the heat exchange amount of the refrigerant in the outdoor heat exchanger 1 is prevented from decreasing, and therefore the heating performance is prevented from decreasing.

As illustrated in FIG. 6, the lower surface of each horizontal bar 23 of the protective net 20 is also not flat, and has an upwardly open (normal) V-shape. The lower surface also includes two inclined surfaces that are inclined to be symmetric to the two upper inclined surfaces (the rear upper surface 23*a* and the front upper surface 23*b*) in the vertical direction. However, the vertical cross-sectional shape of the horizontal bar 23 is not a diamond shape formed by combining the upper surface having a downwardly open V-shape and the lower surface having an upwardly open V-shape. The horizontal bar 23 is formed in such a manner that the length of the rear upper surface 23*a* is greater than the length of the front upper surface 23*b* in vertical cross-section and its vertical cross-sectional shape is a V-shape that is open toward the outdoor heat exchanger 1, that is, toward the front.

The horizontal bar 23 has the V-shape described above in vertical cross-section in such a manner that the horizontal bar 23 has a constant thickness equal to a reference thickness of the protective net 20. As will be described below, each vertical bar 22 has a U-shape in horizontal cross-section, and also has a thickness equal to the reference thickness. The vertical bar 22 illustrated in FIG. 6 is viewed from the side, and its width in the front-rear direction does not represent its thickness. The reference thickness of the protective net 20 is 2 mm. The horizontal bar 23 has a V-shape that is open toward the front in vertical cross-section to have a uniform thickness, in addition to the upper surface inclined to form a downwardly open V shape. Therefore, when the protective net 20 is injection-molded, molten resin smoothly flows, and formation of sink marks is prevented.

The peak of the V-shape of the V-shaped horizontal bar 23 is formed in a round shape. The peak of the V-shape is a portion where the upper surface (rear upper surface 23*a*) and the lower surface are connected. In contrast, the connection portion 23*c* between the rear upper surface 23*a* and the front upper surface 23*b* defining the upper end of the horizontal bar 23 is formed not to have a round shape to prevent snow from accumulating at the connection portion 23*c* at the upper end. The parting surfaces of the molds in injection molding are aligned with the connection position between the rear upper surface 23*a* and the front upper surface 23*b*, that is, the position of the connection portion 23*c*, thereby preventing the connection portion 23*c* defining the upper end of the horizontal bar 23 from having a round shape. That is, the parting line is set in the position of the connection portion 23*c*. As the parting line is set at the upper end (connection portion 23*c*) of the horizontal bar 23, a projection is often formed at the upper end. Thus, no round surface is formed at the connection portion 23*c*.

Figure 7:
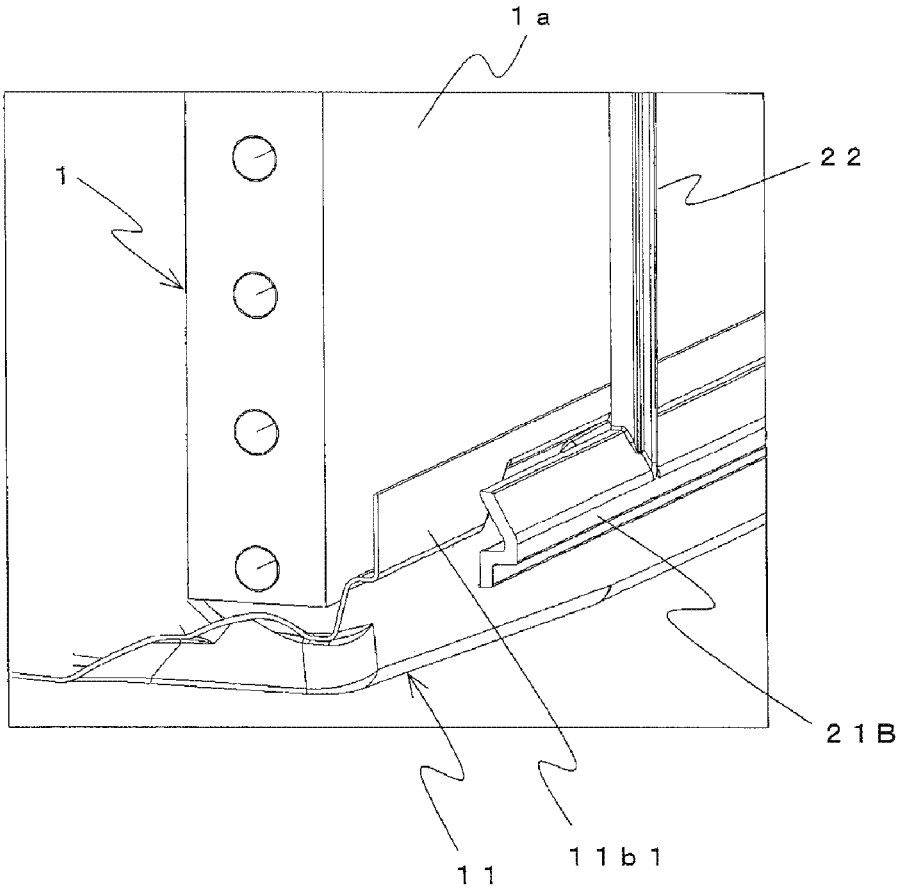
FIG. 7 is a cross-sectional perspective view illustrating a vertical cross-section of a lower frame of the protective net illustrated in FIG. 4.
Figure 8:
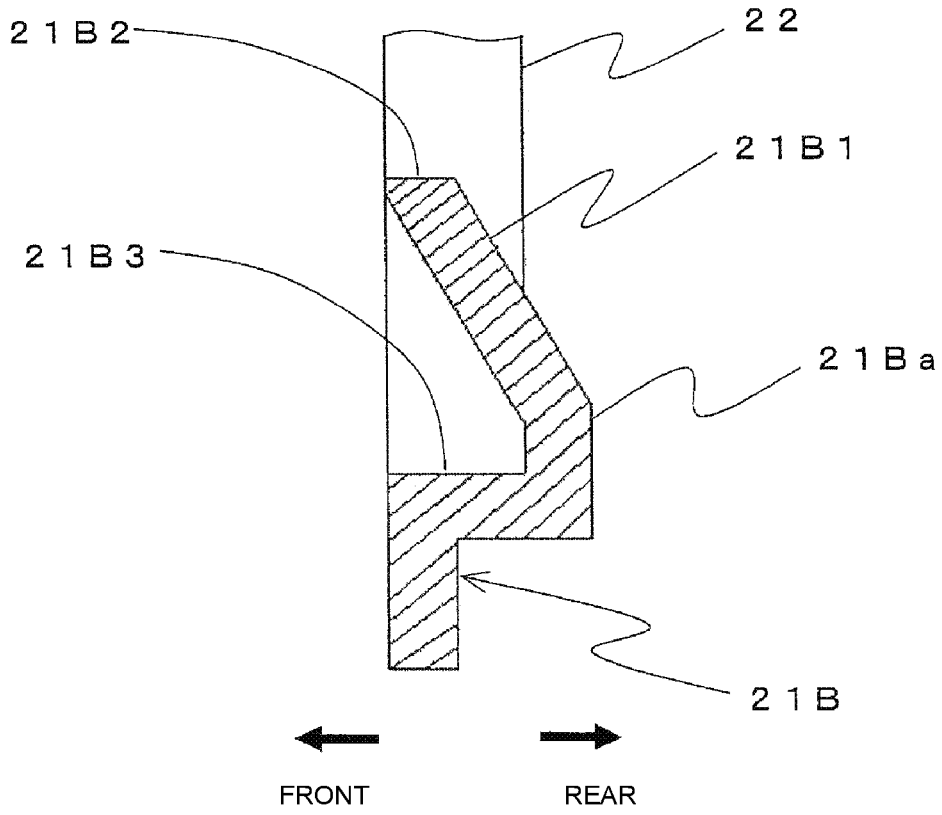
FIG. 8 is a vertical cross-sectional view of the lower frame of the protective net illustrated in FIG. 4.

Further, in the protective net 20, the lower frame 21B of the frame body 21 also has an inclined surface to prevent snow from accumulating on the lower frame 21B. FIG. 7 is a cross-sectional perspective view illustrating a vertical cross-section of the lower frame 21B of the protective net 20. FIG. 8 is a vertical cross-sectional view of the lower frame 21B. The lower frame 21B includes an extended portion 21Ba protruding rearward to secure the strength of the frame body 21 while having the reference thickness. The extended portion 21Ba has, at its upper part, an inclined surface 21B1 inclined downward from the front side to the rear side as an outer surface. Accordingly, when it snows, the snow on the lower frame 21B slides off the rearward and obliquely downward slope of the inclined surface 21B1, so that snow does not accumulate on the lower frame 21B.

The inclined surface 21B1 of the lower frame 21B only has a rearwardly and obliquely downwardly inclined surface, and does not have a forwardly and obliquely downwardly inclined surface corresponding to the front upper surface 23*b* of the horizontal bar 23. The upper end of the extended portion 21Ba is not pointed at an acute angle, but has a narrow flat surface 21B2. The flat surface 21B2 prevents snow from entering the inside of the extended portion 21Ba, and prevents snow from accumulating on an inner bottom surface 21B3 of the extended portion 21Ba wider than the flat surface 21B2. Here, "narrow" and "wider" are in terms of the width in the front-rear direction. If a forwardly and obliquely downwardly inclined surface is formed in place of the flat surface 21B2 at the upper end of the extended portion 21Ba, snow easily enters the inside of the extended portion 21Ba.

As described above, the protective net 20 has the horizontal bars 23 and the lower frame 21B each having, at its upper part, a surface inclined obliquely downward. When it snows, snow slides off the inclined surface, so that snow does not accumulate on the inclined surface. This prevents snow from freezing on the horizontal bars 23 and the lower frame 21B, and prevents a reduction in the opening area of the ventilation openings 24 due to ice. Therefore, the heating performance is maintained while a reduction in the flow rate of the air passing through the outdoor heat exchanger 1 is prevented. Accordingly, the outdoor unit 100 provides high reliability while preventing a reduction in heating capacity due to accumulation of snow on the protective net 20.

As described above, the protective net 20 prevents snow from accumulating on the horizontal bars 23, and prevents snow from freezing on the horizontal bars 23. Meanwhile, during a heating operation, the outdoor heat exchanger 1 performs an evaporation action, so that the moisture in the air condenses, and the condensed water freezes to form frost, on the surfaces of the fins of the outdoor heat exchanger 1. The frost reduces the heat exchanging capacity of the heat exchanger. Therefore, the flow direction of the refrigerant in the refrigeration cycle is temporarily switched to perform a defrosting operation to melt the frost through condensation action by the outdoor heat exchanger 1. In cold districts, after this defrosting operation, the frost melted by the defrosting operation may be frozen while flowing down on the fin surface.

When more snow accumulates and freezes on the ice frozen on the fin surface, the ice grows. If the protective net 20 is disposed in close proximity to the rear surface of the outdoor heat exchanger 1, the growing block of ice on the outdoor heat exchanger 1 covers the horizontal bars 23 of the protective net 20, and more snow accumulates and may freeze on the ice frozen on the horizontal bars 23. In this case, even if the upper surface of each horizontal bar 23 is inclined obliquely downward, the block of ice grows on the horizontal bars 23, resulting in a reduction in the opening area of the ventilation openings 24 of the protective net 20.

Figure 9:
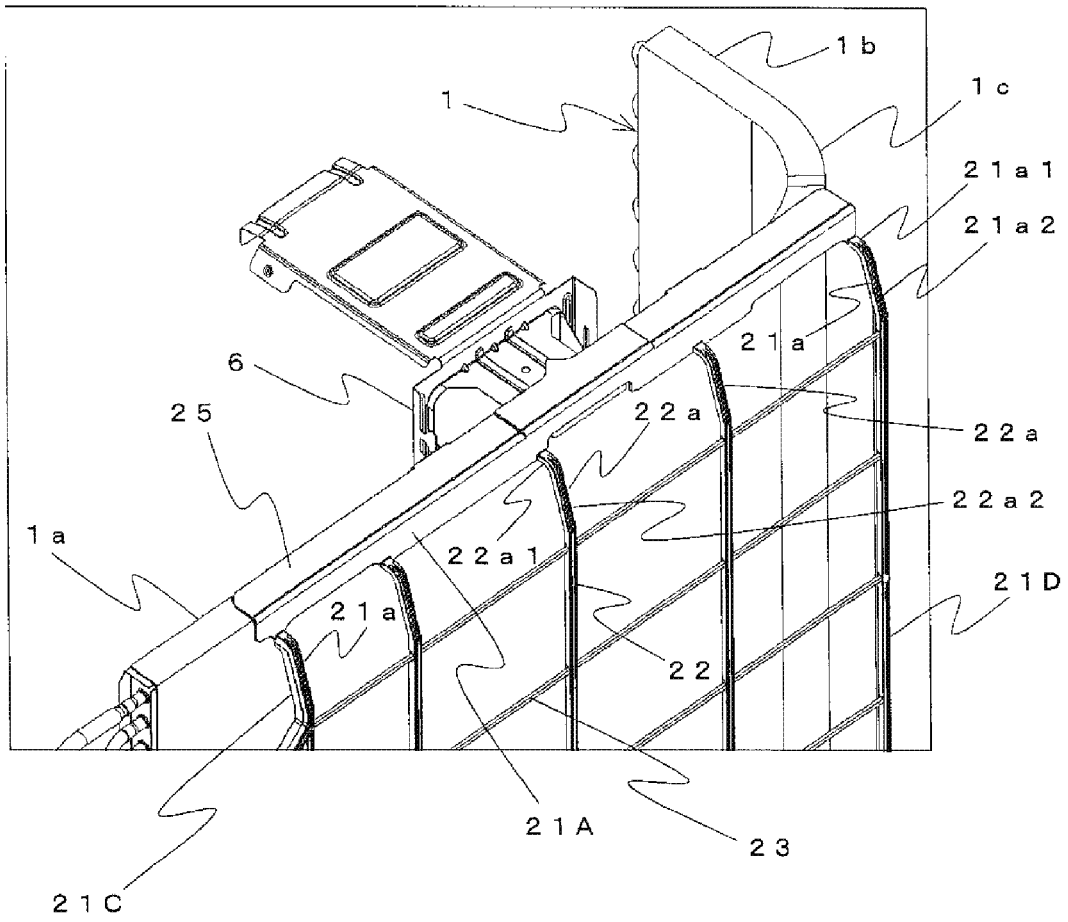
FIG. 9 is a perspective view for describing the upper part of the protective net illustrated in FIG. 4.
Figure 10:
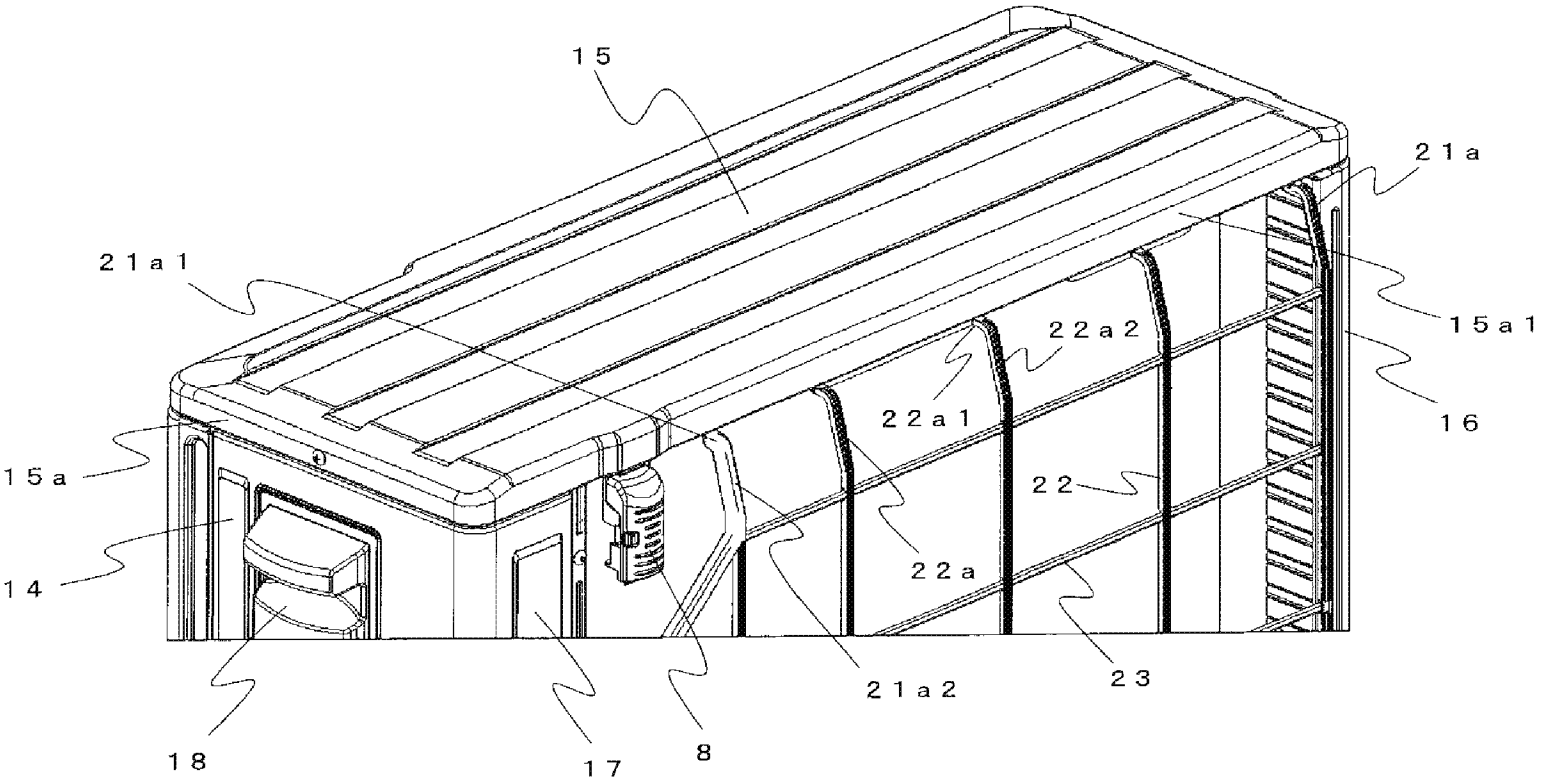
FIG. 10 is a perspective view for describing the upper part of the protective net illustrated in FIG. 4.
Figure 11:
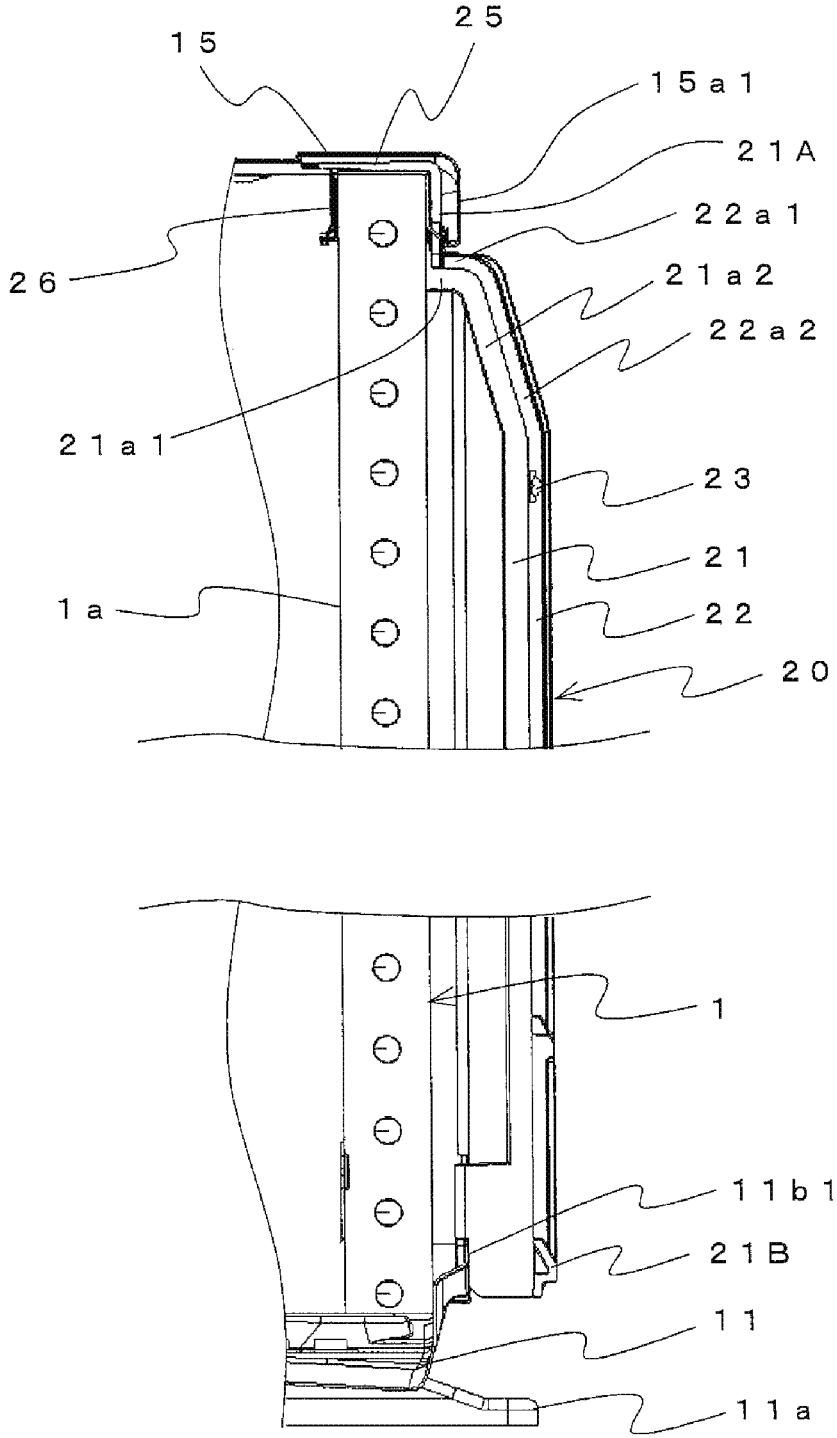
FIG. 11 is a vertical cross-sectional view of the rear part of the outdoor unit illustrated in FIG. 1.

To prevent the ice formed on the outdoor heat exchanger 1 from covering the horizontal bars 23, the protective net 20 is formed in such a manner that the machine-chamber-side frame 21C and the non-machine-chamber-side frame 21D each have an expanded portion 21*a* that is at its upper part and protrudes rearward from the upper frame 21A, and the vertical bars 22 each have an expanded portion 22*a* that is at its upper part and protrudes rearward from the upper frame 21A. Accordingly, the horizontal bars 23 are disposed to be spaced from the rear surface of the outdoor heat exchanger 1. FIGS. 9 and 10 are perspective views for describing the upper part of the protective net 20. FIG. 9 illustrates the protective net 20 with the casing 10 such as the top panel 15 removed, while FIG. 10 illustrates the protective net 20 with the casing 10 attached. FIG. 11 is a vertical cross-sectional view of the rear part of the outdoor unit 100.

As illustrated in FIGS. 9 to 11, the expanded portions 21*a* of the machine-chamber-side frame 21C and the non-machine-chamber-side frame 21D and the expanded portions 22*a* of the vertical bars 22 are all disposed above the uppermost horizontal bar 23. The expanded portion 22*a* of each vertical bar 22 includes a straight portion 22*a*1 projecting rearward from the lower part of the rear surface of the upper frame 21A, and an inclined portion 22*a*2 extending rearward and obliquely downward from the distal end of the straight portion 22*a*1. A portion of the vertical bar 22 below the lower end of the inclined portion 22*a*2 extends straight down and is connected to the lower frame 21 disposed further rear than the upper frame 21A in the front-rear direction. The straight portion 22*a*1 and the inclined portion 22*a*2 of the expanded portion 22*a* are connected to form a smooth curve. The portion of the vertical bar 22*a* below the lower end of the expanded portion 22*a* extends straight down to the lower frame 21B, and all the horizontal bars 23 cross this straight portion.

Similar to the expanded protruding portion 22*a* of the vertical bar 22, the expanded portion 21*a* of each of the paired vertical frames (the machine-chamber-side frame 21C and the non-machine-chamber-side frame 21D) includes a straight portion 21*a*1 and an inclined portion 21*a*2. The portion below the lower end of the expanded portion 21*a* extends straight down to the lower frame 21B. However, the machine-chamber-side frame 21C has a portion inclined in the lateral direction to avoid the outside air temperature detector 8. This portion does not extend downward, but is not inclined in the front-rear direction.

The uppermost horizontal bar 23 crosses each vertical bar 22 at the position below the lower end of the inclined portion 22*a*1. Accordingly, all the plurality of horizontal bars 23 cross the downward straight portion of each vertical bar 22 extending below the expanded portion 22*a*. Thus, all the horizontal bars 23 are disposed to be rearwardly spaced from the outdoor heat exchanger 1 by the length of the expanded portion 22*a* at the upper part of the vertical bar 22 in the front-rear direction (the protruding amount of the expanded portion 22*a*). The lower frame 21B is connected to the lower end of the downward straight portion of the vertical bar 22 extending below the expanded portion 22*a*. Accordingly, all the horizontal bars 23 and the lower frame 21B are disposed further rear than the upper frame 21A in the front-rear direction.

In this outdoor unit 100, the expanded portions 22*a* and the expanded portions 21*a* are formed to have sizes in such a manner that all the horizontal bars 23 and the lower frame 21B are disposed further rear than a rear upper flange 13*a*1 of the top panel 15 and the rear bottom flange 11*b*1 of the bottom plate 11. Thus, the distance between the horizontal bars 23 and the outdoor heat exchanger 1 in the front-rear direction is increased, thereby preventing the ice formed on the outdoor heat exchanger 1 from covering the horizontal bars 23.

Note that, as illustrated in FIG. 11, the lower frame 21B is disposed on the rear side of the rear bottom flange 11*b*1 of the bottom plate 11. The lower frame 21B and the rear bottom flange 11*b*1 face each other with a space between the lower frame 21B and the rear bottom flange 11*b*1 in the front-rear direction.

As described above, as all the horizontal bars 23 are disposed further rear than the rear upper flange 13*a*1 of the top panel 15 and the rear bottom flange 11*b*1 of the bottom plate 11, the ventilation openings 24 of the protective net 22 are disposed further rear than the air inlet 9 at the rear surface of the casing 10. The air flow passes through the ventilation openings 24 of the protective net 20, passes through the air inlet 9, flows into the casing 10, and passes through the outdoor heat exchanger 1.

In this outdoor unit 100, a smallest distance L between the outdoor heat exchanger 1 and the horizontal bars 23, that is, the distance L between the rear surface of the outdoor heat exchanger 1 and the front surfaces of the horizontal bars 23 in the front-rear direction, is about 25 mm. This smallest distance L is about three times as large as that in the case where each vertical bar 22 is not provided with the expanded portion 22*a*. This prevents the ice formed on the outdoor heat exchanger 1 from reaching the horizontal bars 23 to cover the horizontal bars 23, growing on the horizontal bars 23, and blocking the ventilation openings 24.

Figure 12:
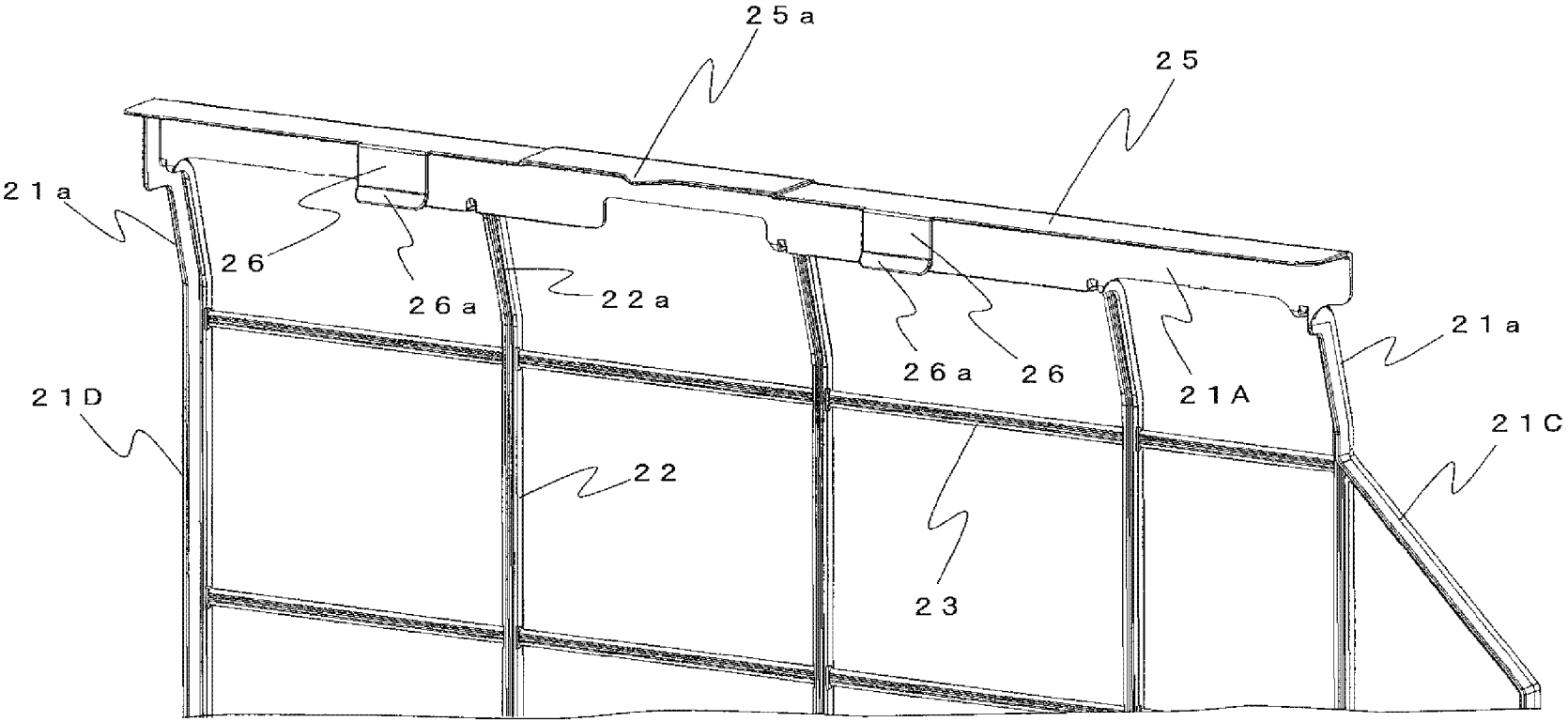
FIG. 12 is a perspective view of the upper part of the protective net illustrated in FIG. 4, as viewed from the front.

The following describes how the protective net 20 is attached to the outdoor unit 100. As illustrated in FIG. 9, the protective net 20 includes a top plate portion 25 connected to the upper end of the upper frame 21A and projecting forward. The top plate portion 25 faces the upper surface of the outdoor heat exchanger 1. FIG. 12 is a perspective view of the upper part of the protective net 20, as viewed from the front. As illustrated in FIG. 12, holding plates 26 are further formed, each connected to the front edge of the top plate portion 25 and projecting downward. In this example, the plurality of holding plates 26 are formed at intervals in the lateral direction. However, a single holding plate 26 elongated in the lateral direction may be formed instead.

The holding plate 26, the top plate portion 25, and the upper frame 21A form a downwardly open U-shaped groove. The U-shaped groove accommodates the upper end of the outdoor heat exchanger 1, while the holding plate 26 and the upper frame 21A hold the upper end of the outdoor heat exchanger 1 between the holding plate 26 and the upper frame 21A. With this configuration, the upper part of the protective net 20 is supported by the outdoor heat exchanger 1. A distal end 26*a* of the holding plate 26 is inclined toward the front to allow easy insertion of the upper end of the outdoor heat exchanger 1 into the U-shaped groove.

The top plate portion 25 has a mark 25*a* for positioning the protective net 20 in the lateral direction when the upper end of the outdoor heat exchanger 1 is to be held between the holding plate 26 and the upper frame 21A. The mark 25*a* has the shape of an isosceles triangle in plan view, and its vertex projects forward to define the front end of the top plate portion 25. The vertex of the mark 25*a* is aligned with a predetermined position of another component (for example, the fan motor support plate 8), so that the protective net 20 is temporarily fixed in a correct position in the lateral direction.

As illustrated in FIGS. 10 and 11, as the top panel 15 is attached after the protective net 20 is attached, the top plate portion 25 of the protective net 20 is covered with the top panel 15. Further, the upper frame 21A is located between the rear surface of the outdoor heat exchanger 1 and the rear upper flange 15*a*1. A major part of the upper frame 21A is aligned with the rear upper flange 15*a*1 in the front-rear direction and covered with the upper flange 15*a*1. However, the lower part of the upper frame 21A to which the expanded portion 22*a* of each vertical bar 22 is connected is exposed outside below the rear upper flange 15*a*1.

Figure 13:
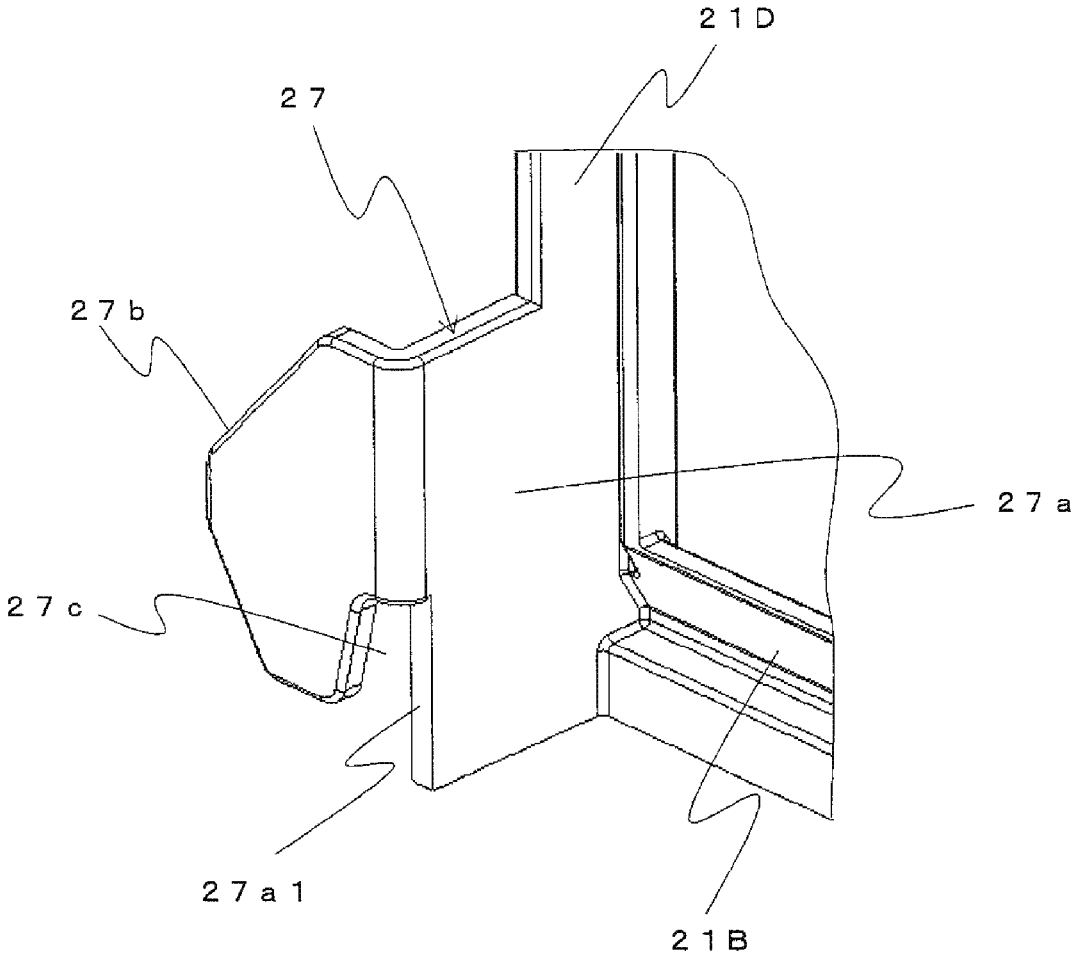
FIG. 13 is an enlarged perspective view illustrating an area including a lower locking portion of the protective net illustrated in FIG. 4.

The upper end of the outdoor heat exchanger 1 is held between the holding plate 26 and the upper frame 21A, and a lower locking portion 27 formed to extend from the lower end of the non-machine-chamber-side frame 21D to the left end (non-machine-chamber-side end) of the lower frame 21B, that is, formed at the non-machine-chamber-side lower end of the frame body 21, is supported by the bottom plate 11. FIG. 13 is an enlarged perspective view of an area including the lower locking portion 27, when the left lower part of the protective net 20 is viewed from the front.

As illustrated in FIG. 13, the lower locking portion 27 is formed integrally with the frame body 21, and includes a first locking plate 27*a* projecting toward the front from the left lower part of the frame body 21, and a second locking plate 27*b* connected to the front end of the first locking plate 27*a*, formed at right angle to the first locking plate 27*a*, and projecting to the left side (non-machine-chamber side). The first locking plate 27*a* and the second locking plate 27*b* have an L-shape in plan view, and the connection portion of the two is formed in a smooth curve. A downwardly open notch 27*c* is cut in the lower part of the curved connection portion between the first locking plate 27*a* and the second locking plate 27*b*. A front end face 27*a*1 of the first locking plate 27*a* is exposed along the notch 27*c*.

The rear bottom flange 11*b*1 of the bottom plate 11 is accommodated in the notch 27*c* of the lower locking portion 27. In this state, the first locking plate 27*a* is located on the rear side of the rear bottom flange 11*b*1, and the second locking plate 27*b* is located on the front side of the rear bottom flange 11*b*1. The first locking plate 27*a* is at right angle to the rear bottom flange 11*a*1, and the second locking plate 27*b* is parallel to the rear bottom flange 11*a*1. The lower locking portion 27 is located on the rear side of the bent portion 1*c* of the outdoor heat exchanger 1.

With this arrangement, the front end face 27*a*1 of the first locking plate 27*a* is in contact with the outer surface of the rear bottom flange 11*b*1 to restrict the forward movement of the left lower part of the protective net 20, and the second locking plate 27*b* is in contact with the inner surface of the rear bottom flange 11*b*1 to restrict the rearward movement of the lower left part of the protective net 20.

In this example, the second locking plate 27*b* projects to the left side, that is, to the non-machine-chamber side, from the first locking plate 27*a*. However, even in the case where the second locking plate 27*b* is formed to project in the opposite direction, that is, to the machine-chamber-side, it is possible to restrict the rearward movement of the left lower part of the protective net 20. However, the distance between the outdoor heat exchanger 1 and the rear bottom flange 11*b*1 in the front-rear direction at the bent portion 1*c* of the outdoor heat exchanger 1 increases toward the non-machine-chamber side as the bent portion 1*c* is curved forward. Therefore, the distance from the outdoor heat exchanger 1 in the front-rear direction can be increased in the case where the second locking plate 27*b* projects to the non-machine-chamber side than in the case where the second locking plate 27*b* projects to the machine-chamber side. Thus, the ice formed on the outdoor heat exchanger 1 is prevented from covering the second locking plate 27*b* of the lower locking portion 27.

Figure 14:
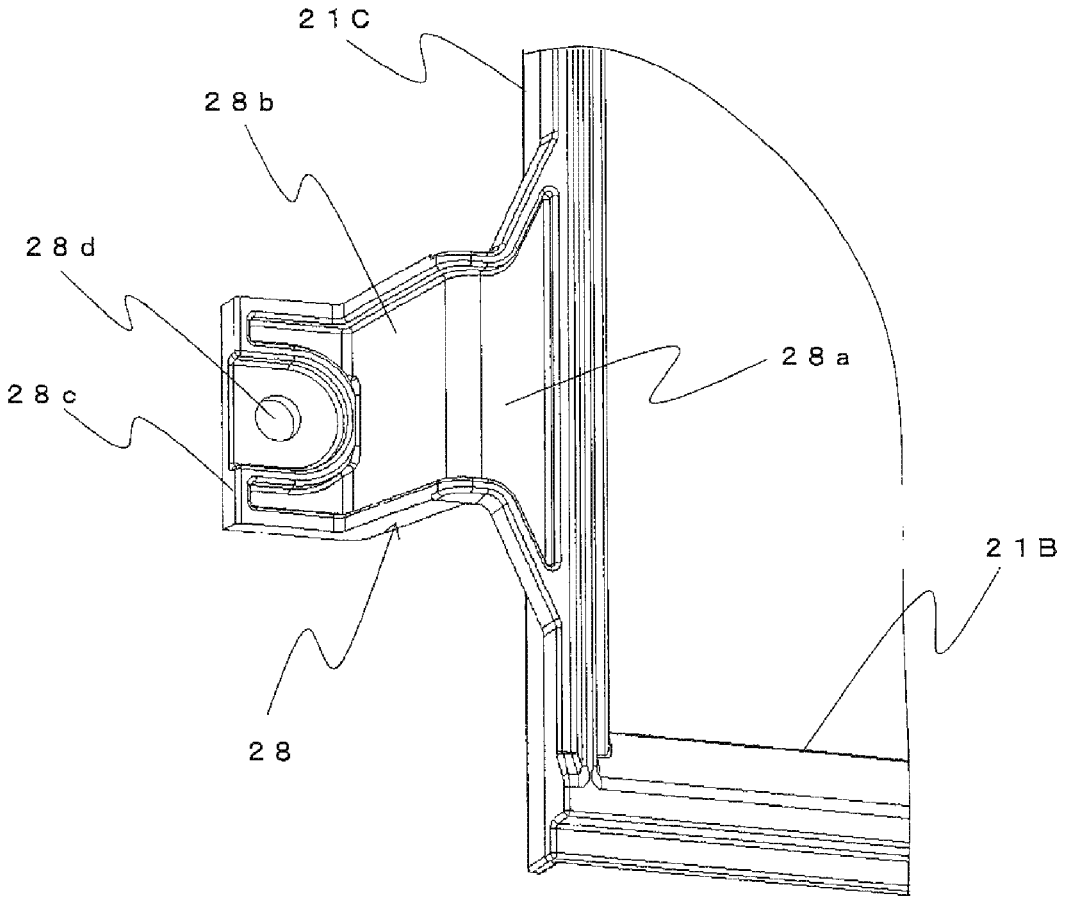
FIG. 14 is an enlarged perspective view illustrating an area including an attachment portion of the protective net illustrated in FIG. 4.

After the protective net 20 is temporarily fixed, with its upper part supported by the upper end of the outdoor heat exchanger 1, and its left lower part supported by the bottom flange 11*b* of the bottom plate 11, the attachment portion 28 projecting from the lower part of the machine-chamber-side frame 21C is fixed with a screw to the right rear panel 17 of the casing 10. FIG. 14 is an enlarged perspective view of an area including the attachment portion 28, when the protective net 20 is viewed from the rear.

The attachment portion 28 is formed integrally with the frame body 21. As illustrated in FIG. 14, the attachment portion 28 includes a trapezoidal base plate 28*a* projecting from the outer side surface of a part of the machine-chamber-side frame 21C below the expanded portion 21*a* to the machine-chamber side (right side), an arm plate 28*b* connected to the distal end of the base plate 28*a* and projecting toward the front, a fixing plate 28*c* connected to the front end of the arm plate 28*b* and projecting to the machine-chamber side (right side), and a screw through-hole 28*d* provided in the fixing plate 28*c*. The fixing plate 28*c* has a front end face that is flat and parallel to the right rear panel 17, and the screw through-hole 28*d* extends through the fixing plate 28*c*.

A fastening screw is screwed through the screw through-hole 28*d* into a screw hole (not illustrated) provided in the right rear panel 17, so that the front end face of the fixing plate 28*c* comes into contact with the right rear panel 17 and is fixed. In this manner, the attachment portion 28 is fixed with a screw to the right rear panel 17, so that the protective net 20 is attached to the rear surface of the outdoor unit 100.

For fixing the attachment portion 28 with a screw, a screw hole may be provided in a sheet metal end plate attached to a machine-chamber-side end face of the outdoor heat exchanger 1, and a screw through-hole may be provided in the right rear panel 17 in place of a screw hole. Then, a fastening screw may be screwed through the screw through-hole 28*d* in the attachment portion 28 and the screw through-hole in the right rear panel into the screw hole in the end plate of the outdoor heat exchanger 1 to fix the three parts, namely, the fixing plate 28*c*, the right rear panel 17, and the end plate of the outdoor heat exchanger 1, altogether.

In place of the lower locking portion 27 at the non-machine-chamber-side lower end, another attachment portion 28 may be provided to project from the lower part of the non-machine-chamber-side frame 21D in the same manner as that provided on the machine-chamber-side frame 21C. Then, the attachment portion 28 of the non-machine-chamber-side frame 21D may be fixed with a screw to the left rear panel 16 to fix the non-machine-chamber-side lower end of the protective net 20. Note that the attachment portion 28 of the non-machine-chamber-side frame 21D is formed in such a manner that the base plate 28*a* and the fixing plate 28*c* project to the non-machine-chamber side (left side).

Further, a plurality of attachment portions 28 may be provided at intervals in the vertical directions suitably to the size of the protective net 20. The attachment portion 28 may be provided on the non-machine-chamber-side frame 21D, in addition to the lower locking portion 27, in a position spaced upward from the attachment portion 28. The number of attachment portions 28 is determined on the basis of the size of the protective net 20.

Figure 15:
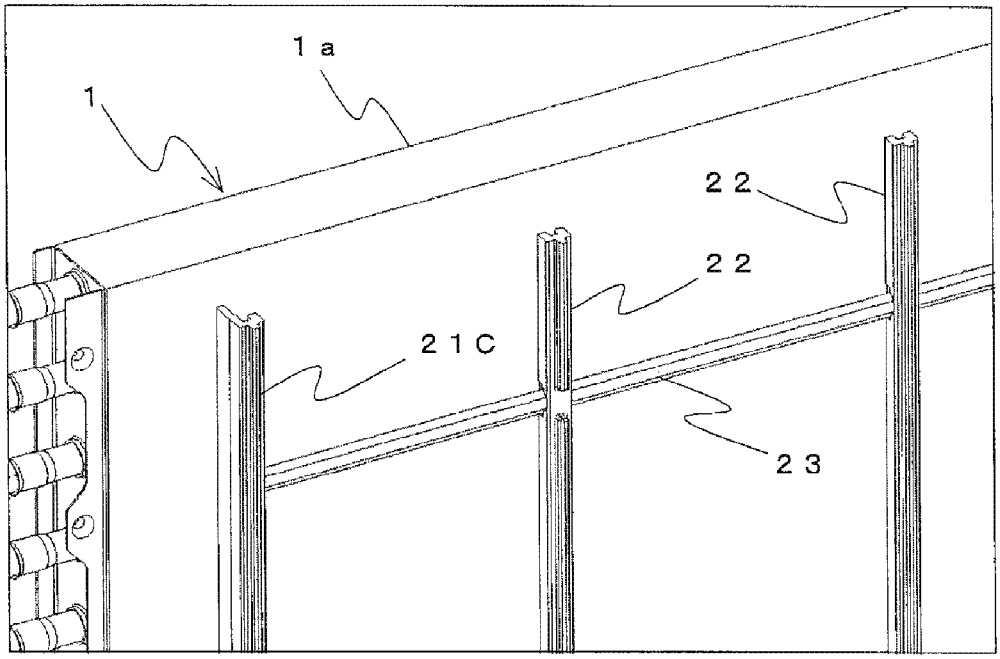
FIG. 15 is a cross-sectional perspective view illustrating horizontal cross-sections of vertical bars of the protective net illustrated in FIG. 4.

FIG. 15 is a cross-sectional perspective view illustrating horizontal cross-sections of the vertical bars 22 of the protective net 20. As illustrated in FIG. 15, the vertical bar 22 has a shape that is open toward the outdoor heat exchanger 1, that is, a U-shape that is open toward the front, in horizontal cross-section to secure the strength and have a uniform thickness. Therefore, when the protective net 20 is injection-molded, the protective net 20 is often warped to project toward the outdoor heat exchanger 1 in horizontal cross-section by the differential shrinkage between the front side and rear side during cooling (shrinkage in the lateral direction is greater on the rear side where the amount of resin is greater) that is presumably caused because of the horizontal cross-sectional shapes of the vertical bars 22.

Figure 16:
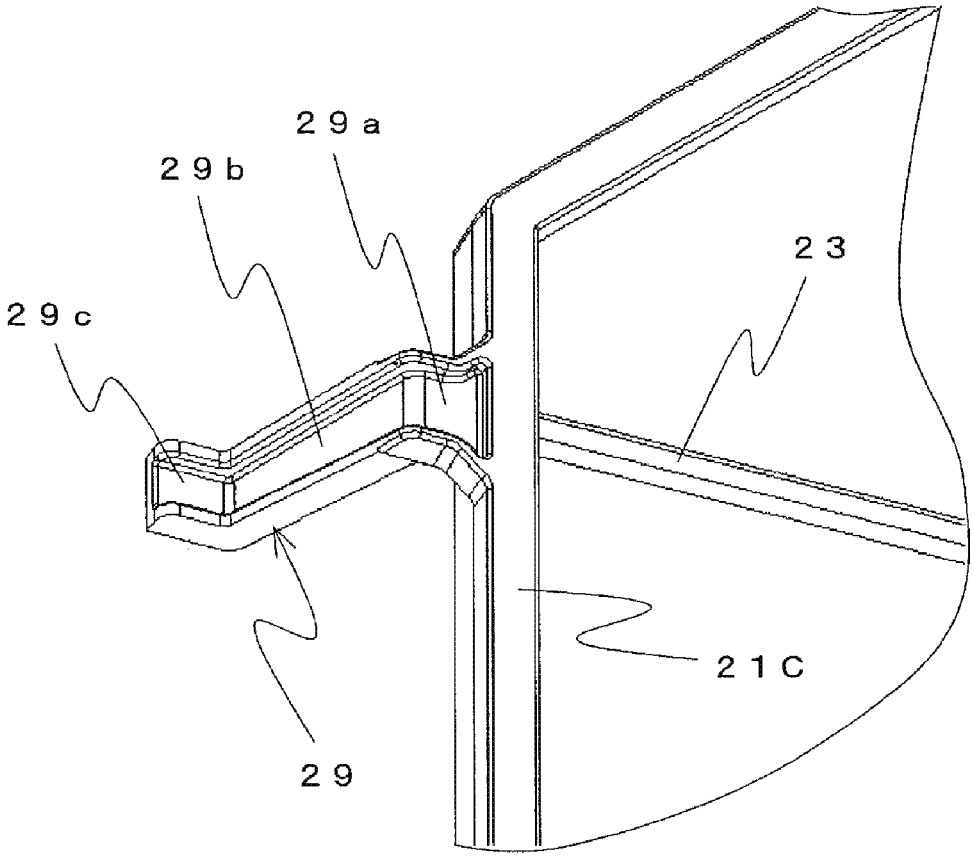
FIG. 16 is an enlarged perspective view illustrating an area including a correction portion illustrated in FIG. 4.

In view of the above, the frame body 21 is provided with a correction portion 29. With this provision, even if such warpage is generated, the warpage is corrected when the protective net 20 is attached to the outdoor unit 100, and the horizontal bars 23 are prevented from coming closer to the outdoor heat exchanger 1. FIG. 16 is an enlarged perspective view of an area including the correction portion 29, when the protective net 20 is viewed from the rear.

The correction portion 29 is formed integrally with the frame body 21, and projects from the machine-chamber-side frame 21C as illustrated in FIG. 16. As illustrated in FIG. 4, the correction portion 29 is disposed substantially at the same position as the uppermost horizontal bar 23 in the vertical direction. The correction portion 29 includes a trapezoidal base plate 29*a* projecting from the outer side surface of a part of the machine-chamber-side frame 21C that is located below the expanded portion 21*a* and is different from the portion from which the attachment portion 28 projects and from the outer side surface of the machine-chamber-side frame 21C to the machine-chamber side (right side), an arm plate 29*b* connected to the distal end of the base plate 28*a* and projecting toward the front, and a contact plate 28*c* connected to the front end of the arm plate 28*b* and projecting to the machine-chamber side (right side).

The arm plate 29*b* is parallel to the arm plate 28*b* of the attachment portion 28. The contact plate 29*c* has a front end face that is flat and parallel to the front end face of the fixing plate 28*c* of the attachment portion 28. The front end face of the contact plate 29*c* is flush with, or located on the front side of the front end face of the fixing plate 28*c*. Therefore, when the protective net 20 is attached to the outdoor unit 100, the contact plate 29*c* is brought into contact with the right rear panel 17. Then, when the fixing plate 28*c* of the attachment portion 28 is fixed with a screw to the right rear panel 17, the contact plate 29*c* presses the right rear panel 17. That is, a pressing force is applied from the contact plate 29*c* to the right rear panel 17. Then, a reaction force of the right rear panel 17 against the pressing force is applied to the contact plate 29*c*, and transmitted to the frame body 21 to be used as a force for correcting the warpage in the lateral direction.

In this example, only one correction portion 29 is formed on the machine-chamber-side frame 21C. However, depending on the status of the warpage of the protective net 20 in the lateral direction, another correction portion 29 may be formed on the non-machine-chamber frame 21D to press the left rear panel 16 in such a manner that a reaction force is received also from the left rear panel 16. On any of the machine-chamber-side frame 21C and the non-machine-chamber-side frame 21D, the number of correction portions 29 is not limited to one, and a plurality of correction portions 29 may be formed at intervals in the vertical directions suitably to the size of the protective net 20 to increase the number of points where the reaction force is received. The position of the correction portion 29 on each of the paired vertical frames of the frame body 21 in the vertical direction may be appropriately determined depending on the status of occurrence of warpage.

The attachment portion 28 and the correction portion 29 are formed on the machine-chamber-side frame 21C or the non-machine-chamber-side frame 21D excluding the expanded portions 21*a*. Accordingly, the parts of the machine-chamber-side frame 21C or the non-machine-chamber-side frame 21D where these portions are formed are disposed further rear than the right rear panel 16 and the left rear panel 17. Therefore, the attachment portion 28 needs the arm plate 28*b* projecting forward in such a manner that the fixing plate 28*c* can be placed in contact with the right rear panel 17 or the left rear panel 16. The arm plate 28*b* compensates for the distance by which the projecting portion 21*a* projects rearward. The same applies to the arm plate 29*b* of the correction portion 29. The upper surfaces of the arm plates 28*b* and 29*b* may be inclined to prevent snow from accumulating on the arm plates 28*b* and 29*b*.

As described above, the horizontal bar 23 has a V-shape that is open toward the outdoor heat exchanger 1 in vertical cross-section. Therefore, when the protective net 20 is injection-molded, the protective net 20 is often warped to protrude toward the outdoor heat exchanger 1 in vertical cross-section by the differential shrinkage between the front side and rear side during cooling (shrinkage in the vertical direction is greater on the rear side) that is presumably caused because of the vertical cross-sectional shapes of the horizontal bars 23. The amount of deformation by this warpage in the vertical direction is smaller than the amount of deformation by the warpage in the lateral direction that is presumably caused because of the cross-sectional shapes of the vertical bars 22.

Figure 17:
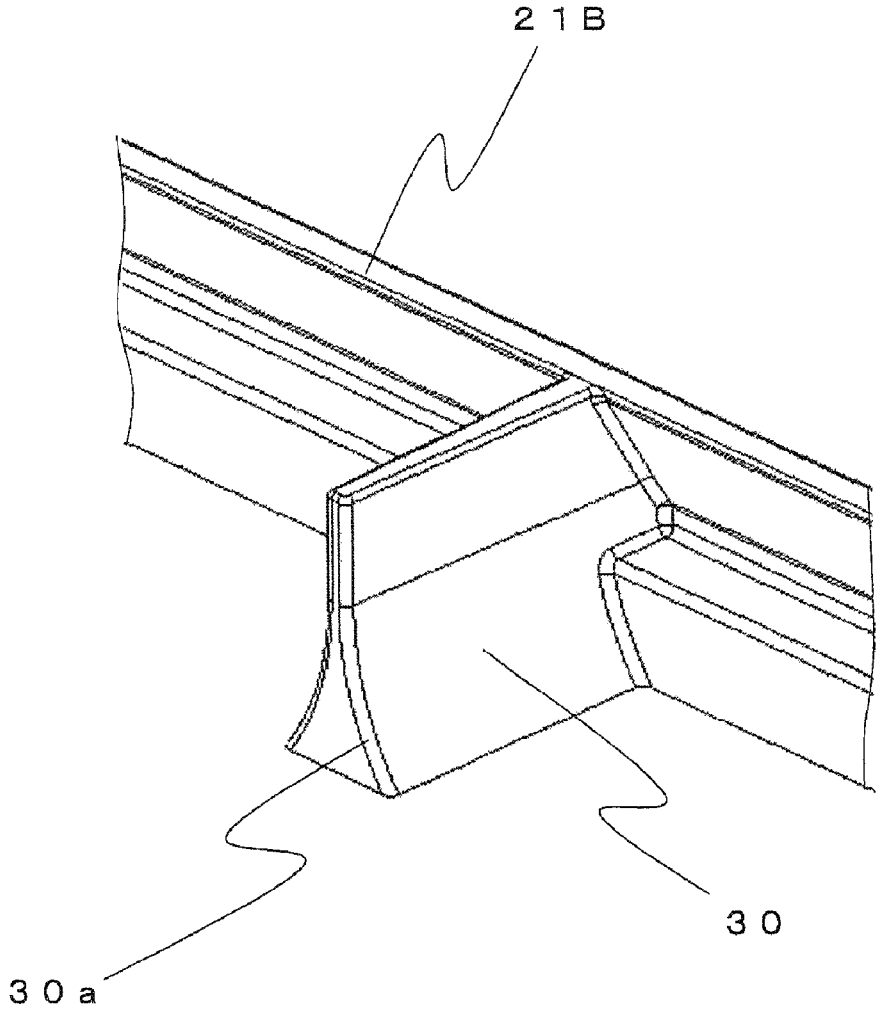
FIG. 17 is an enlarged perspective view of a correction projection of the protective net illustrated in FIG. 4.

In view of the above, the lower frame 21B of the frame body 21 is provided with a correction projection 29. With this provision, even if the warpage described above is generated in vertical cross-section, the warpage is corrected when the protective net 20 is attached to the outdoor unit 100, and the horizontal bars 23 are prevented from coming closer to the outdoor heat exchanger 1. FIG. 17 is an enlarged perspective view of the correction projection 30 when the protective net 20 is viewed from the front.

The correction projection 30 is formed integrally with the frame body 21, and projects toward the front from the lower frame 21B as illustrated in FIG. 4. As illustrated in FIG. 17, the correction projection 30 has a substantially triangular shape in front view. Accumulation of snow on the correction projection 30 is prevented by reducing the area of the upper surface while securing the required strength.

The correction projection 30 has a forward projection amount in such a manner that, when the attachment portion 28 is fixed with a screw, a front end face 30*a* of the correction projection 30 comes into contact with and presses the outer surface of the rear bottom flange 11*b*1 of the bottom plate 11. Therefore, when the protective net 20 is attached to the outdoor unit 100, the correction projection 30 presses the rear bottom flange 11*b*1. That is, a pressing force is applied from the correction projection 30 to the right rear panel 17. Then, a reaction force of the bottom flange 11*b* against the pressing force is applied to the correction projection 30, and transmitted to the frame body 21 to be used as a force for correcting the warpage in the vertical direction.

In this example, only one correction projection 30 is formed on the lower frame 21B. However, a plurality of correction projections 30 may be formed at intervals in the lateral direction suitably to the size of the protective net 20. The position of the correction projection 30 on the lower frame 21B in the lateral direction may be appropriately determined depending on the status of occurrence of warpage.

Note that there is no clear division between the correction portion 29 as a part for correcting the warpage of the protective net 20 in the lateral direction and the correction projection 30 as a part for correcting the warpage of the protective net 20 in the vertical direction. The correction portion 29 also contributes to correction of the warpage in the vertical direction, and the correction projection 30 also contributes to correction of the warpage in the lateral direction. That is, the correction portion 29 corrects mainly the warpage of the protective net 20 in the lateral direction, and the correction projection 30 corrects mainly the warpage of the protective net 20 in the vertical direction.

Figure 18:
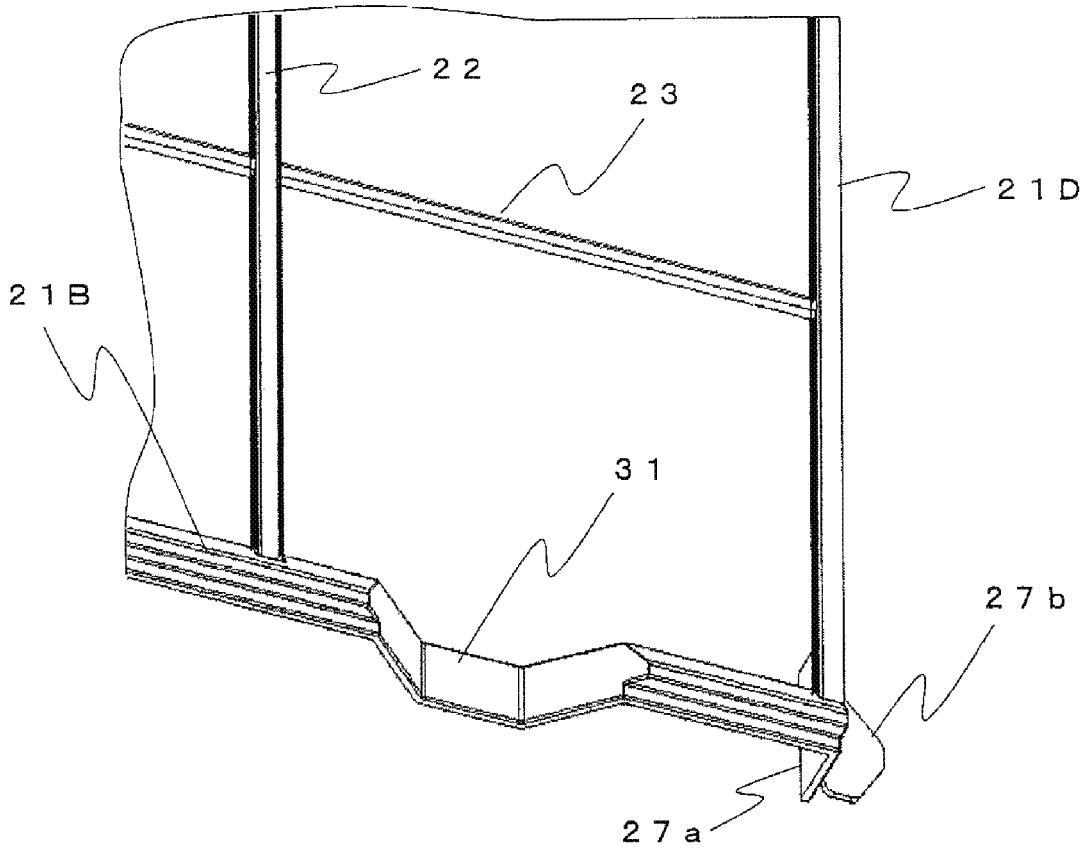
FIG. 18 is an enlarged perspective view illustrating an area including a forward clearance portion illustrated in FIG. 4.

Further, as illustrated in FIG. 3, the lower frame 21B is provided with a forward clearance portion 31 located above the leg 11*a* of the bottom plate 11 and partly projecting toward the bottom plate 11, that is, toward the front. FIG. 18 is an enlarged perspective view of an area including the forward clearance portion 31, when the protective net 20 is viewed from the rear.

Each of the opposite ends of the leg 11*a* projecting beyond the bottom plate 11 in the front-rear direction may have a through hole or a notch through which a bolt is inserted in such a manner that the leg 11*a* is fixed to an outdoor unit stand with the bolt. The lower frame 21B is positioned on the rear side of the rear bottom flange 11*b*1 to be spaced from the rear bottom flange 11*b*1 by the expanded portion 21*a* defining the upper portion, and therefore is located close to the rear end of the leg 11*a* in the front-rear direction. Therefore, when an installation worker fixes the rear end of the leg 11*a* with a bolt, the lower frame 21B may interfere with the work.

In consideration of this, the lower frame 21B is provided with the forward clearance portion 31 located above the leg 11*a*, extending across the leg 11*a* in the lateral direction, and partly displaced toward the rear bottom flange 11*b*1 of the bottom plate 11, when the protective net 20 is attached to the outdoor unit 100. Therefore, a workspace is secured on the upper side of the rear end of the leg 11*a*, and the lower frame 21B does not interfere with the work for fixing the leg 11*a* with a bolt.

The outdoor unit 100 is formed in such a manner that the protective net 20 is not disposed above one leg 11*a* of the paired legs 11*a* that is located on the machine-chamber side, only one forward clearance portion 31 is formed above the leg 11*a* disposed on the machine-chamber side. In the case where a plurality of legs 11*a* are provided under the protective net 20, the forward clearance portion 31 may be provided for each of the legs 11*a*.

When the protective net 20 is attached to the outdoor unit 100, the front end face of the forward clearance portion 31 faces the rear bottom flange 11*b*1 of the bottom plate 11. However, the forward clearance portion 31 may be formed to have the size in such a manner that the front end face of the forward clearance portion 31 presses the rear bottom flange 11*b*1 (the length in such a manner that the front end face of the forward clearance portion 31 projects toward the front from the lower frame 21B) when the protective net 20 is attached. In this case, similar to the correction projection 30, the forward clearance portion 31 can also be utilized to correct the warpage of the protective net 20.

As described above, in the protective net 20 of Embodiment 1, the upper surface of each horizontal bar 23 is formed in a downwardly open V-shape, by combining two inclined surfaces, namely, the rear upper surface 23*a* inclined rearward and obliquely downward and the front upper surface 23*b* inclined forward and obliquely downward. When it snows, the snow on the horizontal bars 23 slides off the downward slope of the rear upper surface 23*a* or the front upper surface 23*b*, so that snow does not accumulate on the horizontal bars 23. This prevents snow from freezing into ice on the horizontal bars 23, and prevents a reduction in the opening area of the ventilation openings 24 of the protective net 20 due to ice. Accordingly, the outdoor unit 100 provides high reliability while preventing a reduction in the flow rate of the air passing through the outdoor heat exchanger 1, and preventing a reduction in heating performance.

Also, as snow does not freeze on the horizontal bars 23, it is possible to prevent a situation where the ice grows on the horizontal bars 23, and comes into contact with the outdoor heat exchanger 1 to deform fins of the outdoor heat exchanger 1. Accordingly, the outdoor unit 100 provides high reliability while preventing a reduction in the flow rate of the air passing through the outdoor heat exchanger 1 due to deformation of the fins.

The horizontal bar 23 does not have a round surface at its upper end defined by the connection portion 23*c* between the rear upper surface 23*a* and the front upper surface 23*b*. When the protective net 20 is injection-molded with resin, the parting surfaces of the molds are aligned with the position of the connection portion 23*c*, thereby preventing the connection portion 23*c* from having a round surface (round shape). Thus, as the horizontal bar 23 does not have a round surface at its upper end, the snow on the horizontal bar 23 quickly slides off the horizontal bar 23 without remaining on the horizontal bar 23.

According to the protective net 20, the lower frame 21B of the frame body 21 has, at its upper part, the inclined surface 21B1 inclined downward and rearward. Accordingly, when it snows, the snow on the lower frame 21B slides off the slope of the inclined surface 21B1, so that snow does not accumulate on the lower frame 21B. This prevents snow from freezing into ice on the lower frame 21B, and prevents a reduction in the opening area of the ventilation openings 24 of the protective net 20 due to ice. Accordingly, the outdoor unit 100 provides high reliability while preventing a reduction in the flow rate of the air passing through the outdoor heat exchanger 1, and preventing the heat exchange amount of the refrigerant in the outdoor heat exchanger 1.

The protective net 20 has the expanded portion 22*a* projecting rearward beyond the upper frame 21A of the frame body 21 at the upper part of each vertical bar 22 above the uppermost horizontal bar 23, and the portion of the vertical bar 23 below the expanded portion 22*a* extends straight down to the lower frame 21B. Further, all the vertical bars 23 cross the vertical bars 22 each other below the expanded portions 22*a*. With this configuration, all the horizontal bars 23 are disposed to be spaced from the rear surface of the outdoor heat exchanger 1 by the distance by which the expanded portion 22*a* of each vertical bar 22 projects rearward. This prevents the ice formed on the outdoor heat exchanger 1 from covering the horizontal bars 23, growing on the horizontal bars 23, and blocking the ventilation openings 24. With this configuration, the outdoor unit 100 prevents a reduction in the flow rate of the air passing through the ventilation openings 24 of the protective net 20 to the outdoor heat exchanger 1.

Each horizontal bar 23 has two inclined surfaces, namely, the rear upper surface 23*a* and the front upper surface 23*b* at its upper surface, and has a V-shape that is open toward the outdoor heat exchanger 1 in vertical cross-section. Accordingly, the horizontal bar 23 has a uniform thickness. Therefore, when the protective net 20 is injection-molded, molten resin smoothly flows, and formation of sink marks is prevented.

The protective net 20 includes the attachment portion 28 that projects from the machine-chamber-side frame 21C of the frame body 21 and is fixed with a screw to the right rear panel 17 of the casing 10, or that projects from the non-machine-chamber-side frame 21D and is fixed with a screw to the left rear panel 16. The attachment portion 28 includes the arm plate 28*b* extending forward. The portion of the machine-chamber-side frame 21C or the non-machine-chamber-side frame 21D extending below the expanded portion 21*a* defining the upper portion is disposed to be spaced from the rear surface of the outdoor heat exchanger 1 by the distance by which the expanded portion 21*a* projects rearward. Even with this configuration, as the attachment portion 28 includes the arm plate 28*b*, the fixing plate 28*c* can be put in contact with the right rear panel 17 or the left rear panel 16.

The protective net 20 has, at the lower part of the frame body 21 on the non-machine-chamber side, the lower locking portion 27 that engages the rear bottom flange 11*b*1 of the bottom plate 11 to restrict the movement of the non-machine-chamber-side lower part of the protective net 20 in the front-rear direction. When attaching the protective net 20, the worker only needs to put the rear bottom flange 11*b*1 into the notch 27*c* of the lower locking portion 27. This improves the workability. The lower locking portion 27 is provided to be located on the rear side of the bent portion 1*c* of the outdoor heat exchanger 1, and therefore is greatly spaced from the outdoor heat exchanger 1 in the front-rear direction. This prevents the ice formed on the outdoor heat exchanger 1 from covering the lower locking portion 27.

The protective net 20 includes the correction portion 29 that projects toward the front from the machine-chamber-side frame 21C of the frame body 21 to be in contact with the right rear panel 17 of the casing 10, or that projects from the non-machine-chamber-side frame 21D to be in contact with the left rear panel 16. When the attachment portion 28 is fixed with a screw, the correction portion 29 presses the right rear panel 17 or the left rear panel 16, and receives a reaction force against the pressing force from the right rear panel 17 or the left rear panel 16. With this provision, even when the protective net 20 is warped to protrude toward the outdoor heat exchanger 1, the warpage is corrected by the reaction force applied to the correction portion 29 when the protective net 20 is attached. This prevents the horizontal bars 23 from being positioned close to the outdoor heat exchanger 1.

The protective net 20 includes the correction projection 30 that projects forward from the lower frame 21B of the frame body 21 to be in contact with the rear bottom flange 11*b*1 of the bottom plate 11. When the attachment portion 28 is fixed with a screw, the correction projection 30 presses the rear bottom flange 11*b*1, and receives a reaction force against the pressing force from the rear bottom flange 11*b*1. With this provision, even when the protective net 20 is warped to protrude toward the outdoor heat exchanger 1, the warpage is corrected by the reaction force applied to the correction projection 30 when the protective net 20 is attached. This prevents the horizontal bars 23 from being positioned close to the outdoor heat exchanger 1.

The protective net 20 includes, at the lower frame 21B of the frame body 21, the forward clearance portion 31 partly projecting forward. The forward clearance portion 31 is disposed above the leg 11*a* of the bottom plate 11, and extends across the leg 11*a* in the lateral direction. As each of the paired vertical frames has the expanded portion 21*a* and each of the vertical bars 22 has the expanded portion 22*a*, the lower frame 21B is disposed on the rear side of the rear bottom flange 11*b*1 to be spaced from the rear bottom flange 11*b*1. However, with the provision of the forward clearance portion 31, a workspace can be secured above the leg 11*a*. Therefore, when an installation worker fixes the leg 11*a* to an outdoor unit stand with a bolt, for example, the lower frame 21B does not interfere with the work.

Embodiment 2

Figure 19:
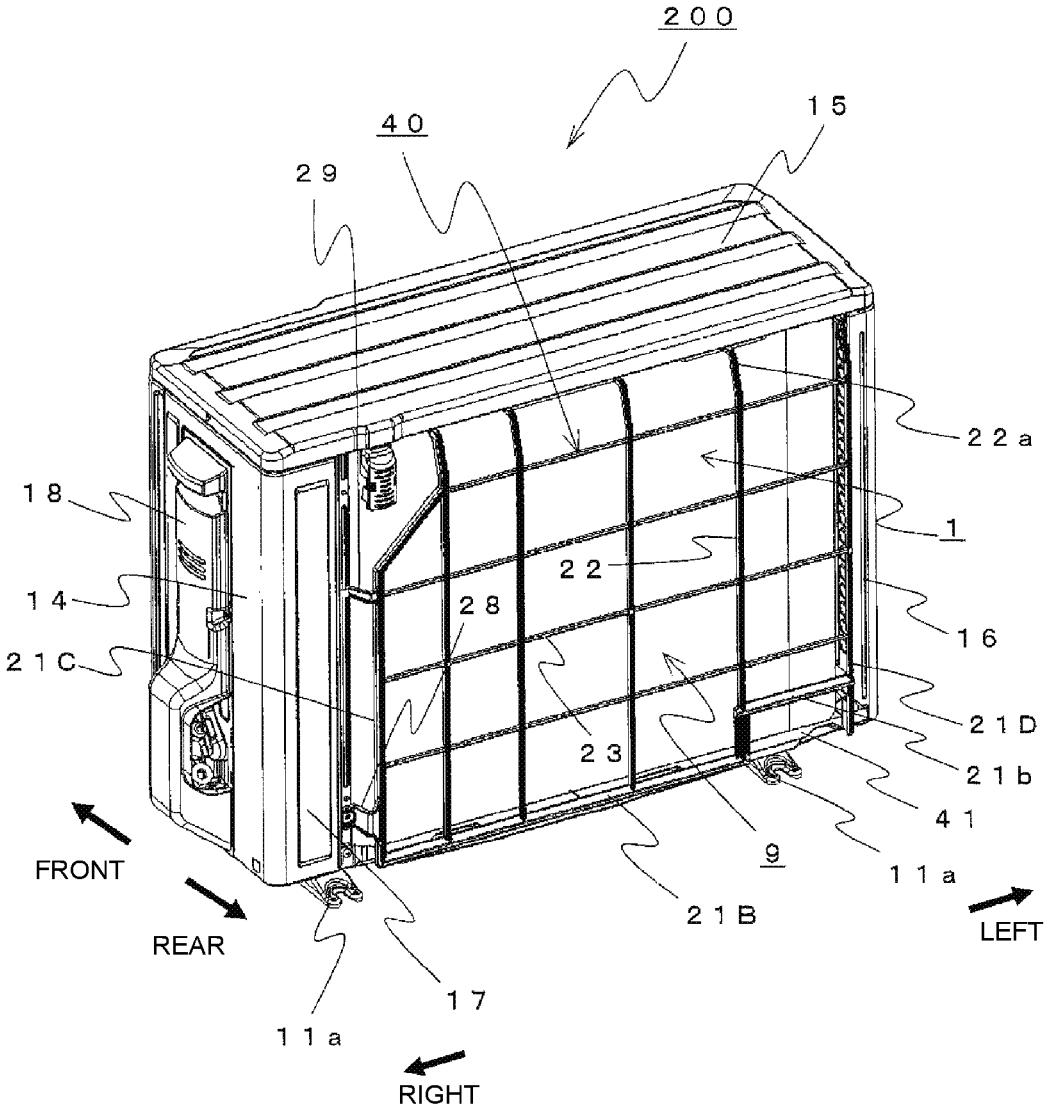
FIG. 19 is an external perspective view of an outdoor unit for an air-conditioning apparatus as viewed from the rear, according to Embodiment 2 of the present disclosure.
Figure 20:
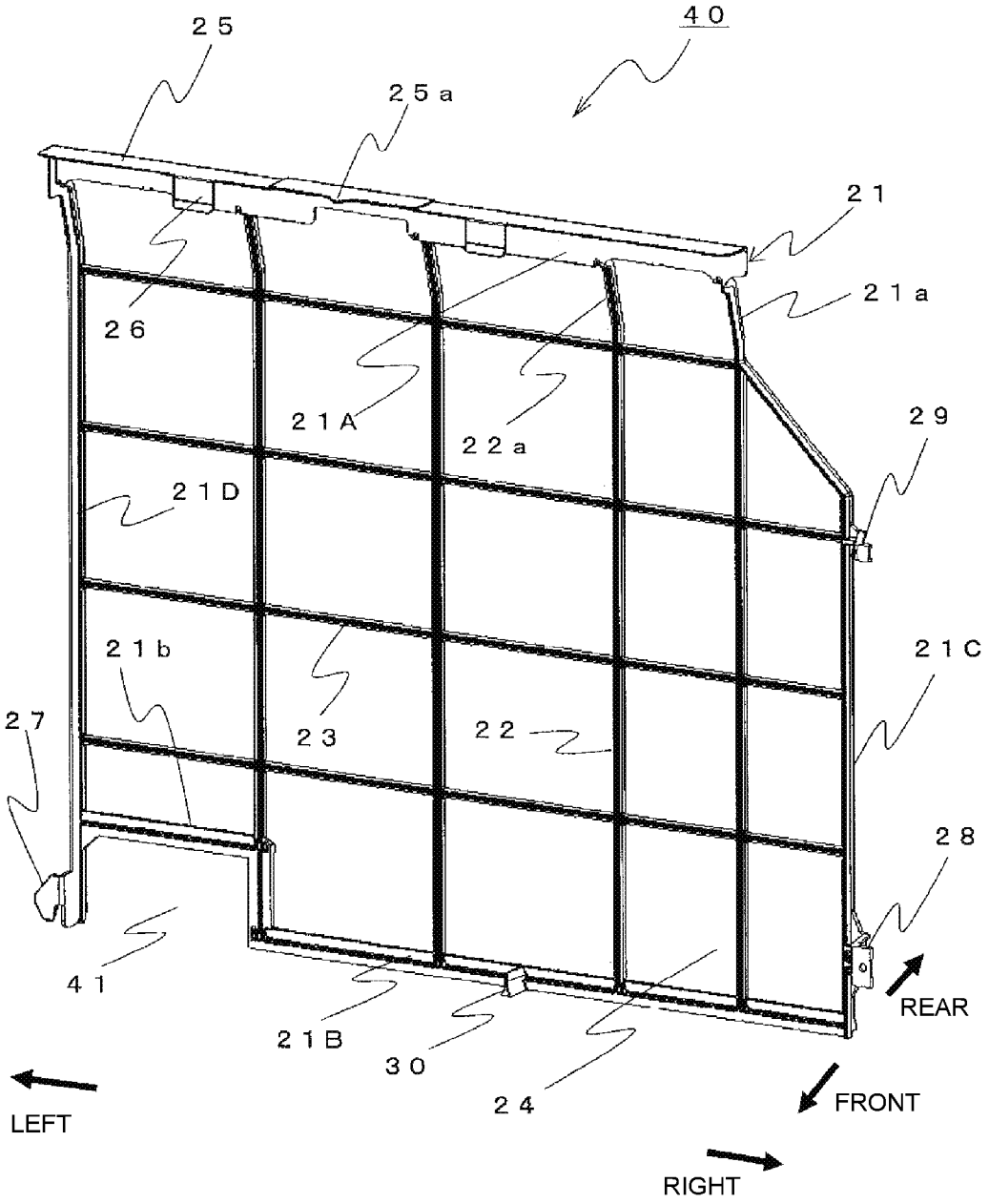
FIG. 20 is a perspective view of only a protective net of the outdoor unit illustrated in FIG. 19.

In the following, Embodiment 2 of the present disclosure will be described with reference to the drawings. FIG. 19 is an external perspective view of an outdoor unit 200 for an air-conditioning apparatus as viewed from the rear, according to Embodiment 2 of the present disclosure. FIG. 20 is a perspective view of only a protective net 40 attached to the air inlet 9 of the outdoor unit 200 as viewed from the front, illustrating the surface facing the outdoor heat exchanger 1. This protective net 40 does not include the forward clearance portion 31 that is included in the protective net 20 of the outdoor unit 100 of Embodiment 1, but includes an upward clearance portion 41 instead. The configurations and effects of the outdoor unit 200 and the protective net 40 are the same as those of the outdoor unit 100 and the protective net 20 of Embodiment 1, except for the upward clearance portion 41. The elements identical or equivalent to those of the outdoor unit 100 and the protective net 20 are denoted by the same reference signs, and description of the elements will be omitted.

As illustrated in FIG. 19, the leg 11*a* disposed on the non-machine-chamber side is located between the non-machine-chamber-side frame 21D and the vertical bar 22 closest to the non-machine-chamber-side frame 21D in the lateral direction. As also illustrated in FIG. 20, the lower frame 21B of the protective net 40 has an upward shifted portion 21*b* between the non-machine-chamber-side frame 21D and the above-described vertical bar 22. The upward shifted portion 21*b* is shifted upward from the other part of the lower frame 21B. The upward shifted portion 21*b* is closer to the horizontal bar 23 than the lower frame 21B excluding the upward shifted portion 21*b* is.

As the upward shifted portion 21*b* is shifted upward, the upward clearance portion 41 defining a clearance is formed under the upward shifted portion 21*b*. The upward clearance portion 41 is disposed between the non-machine-chamber-side frame 21D and the vertical bar 22 next to the non-machine-chamber-side frame 21D, and hence extends across the leg 11*a* disposed on the non-machine-chamber-side in the lateral direction. Therefore, a workspace is secured on the upper side of the rear end of the leg 11*a*, and the lower frame 21B does not interfere with the work for fixing the leg 11*a* with a bolt.

As the leg 11*a* disposed on the machine-chamber side is not located under the protective net 40, the protective net 40 has the upward clearance portion 41 only between the non-machine-chamber-side frame 21D and the vertical bar 22 next to the non-machine-chamber-side frame 21D. If the leg 11*a* is disposed between the machine-chamber-side frame 21C and the vertical bar 22 next to the machine-chamber-side frame 21C in the lateral direction, or between the adjacent vertical bars 22, the upward clearance portion 41 may be formed by shifting upward the portion of the lower frame 21B between the machine-chamber-side frame 21C and the vertical bar 22 next to the machine-chamber-side frame 21C, or between the adjacent vertical bars 22 as the upward shifted portion 21*b*. That is, the upward clearance portion 41 is disposed between the vertical frame and the vertical bar 22 next to the vertical frame, or between the adjacent vertical bars 22 that are disposed across the leg 11*a* in the lateral direction.

As described above, the lower frame 21B of the protective net 40 has the upward shifted portion 21*b* located above the leg 11*a*, extending across the leg 11*a* in the lateral direction, and partly shifted upward, so that the upward clearance portion 41 defining a clearance is provided under the upward shifted portion 21*b*. The lower frame 21B is disposed on the rear side of the rear bottom flange 11*b*1 to be spaced from the rear bottom flange 11*b*1. However, with the provision of the upward clearance portion 41, a workspace is secured above the leg 11*a*. Therefore, when an installation worker fixes the leg 11*a* to an outdoor unit stand with a bolt, for example, the lower frame 21B does not interfere with the work.

In the above description, the outdoor heat exchanger 1 is one that has an L-shape in plan view. However, the prevent disclosure is also applicable to a heat exchanger having an I-shape in plan view, that is, a flat-type heat exchanger that includes only the long side portion 1*a* parallel to the rear bottom flange 11*b*1 and does not include the short side portion 1*b* and the bent portion 1*c*, and the same effects are achieved. In this case, the entire heat exchanger may face the air inlet 9.

REFERENCE SIGNS LIST

1 outdoor heat exchanger 9 air inlet 10 casing 11 bottom plate 11*a* leg 11*b* bottom flange 11*b*1 rear bottom flange 20 protective net 21 frame body 21A upper frame 21*a* expanded portion 21B lower frame 21B1 inclined surface 21*b* upward shifted portion 21C machine-chamber-side frame (vertical frame) 21D non-machine-chamber-side frame (vertical frame) 22 vertical bar 22*a* expanded portion 23 horizontal bar 23*a* rear upper surface 23*b* front upper surface 23*c* connection portion 24 ventilation opening 28 attachment portion 28*b* arm plate 28*c* fixing plate 29 correction portion 29*b* arm plate 29*c* contact plate 30 correction projection 31 forward clearance portion 40 protective net 41 upward clearance portion 100 outdoor unit 200 outdoor unit

The invention claimed is:

1. An outdoor unit for an air-conditioning apparatus, comprising:

a casing having an air inlet formed at a rear surface of the casing;

an outdoor heat exchanger disposed in the casing in such a manner that at least a part of the outdoor heat exchanger faces the air inlet; and a protective net having a plurality of ventilation openings and disposed over the air inlet, wherein the protective net includes a frame body defining an outer periphery of the protective net, and a plurality of vertical bars and a plurality of horizontal bars crossing each other inside the frame body and defining the plurality of ventilation openings, the frame body includes an upper frame and a lower frame between which the plurality of vertical bars extend, the lower frame is disposed further rear than the upper frame in a front-rear direction, each of the plurality of vertical bars includes a first expanded portion protruding rearward from the upper frame, and a portion of the vertical bar that is located below the first expanded portion extends straight down and is connected to the lower frame, the plurality of horizontal bars cross the plurality of vertical bars below the first expanded portions, and each of the plurality of horizontal bars has an upper surface formed by combining a rear upper surface inclined downward and rearward and a front upper surface inclined downward and forward, an upper end of the rear upper surface and an upper end of the front upper surface being connected to each other at an acute angle.

2. The outdoor unit for an air-conditioning apparatus of claim 1, wherein a parting line is set in a position of a connection portion between the rear upper surface and the front upper surface, the connection portion defining an upper end of each of the plurality of horizontal bars.

3. The outdoor unit for an air-conditioning apparatus of claim 1, wherein the lower frame has an inclined surface that is located at an upper part of the lower frame and is inclined downward and rearward.

4. The outdoor unit for an air-conditioning apparatus of claim 1, wherein the frame body includes a pair of vertical frames each connecting a corresponding one of opposite ends of the upper frame to a corresponding one of opposite ends of the lower frame in a vertical direction, wherein each of the pair of vertical frames includes a second expanded portion protruding rearward from the upper frame, and a portion of the vertical frame that is located below the second expanded portion extends straight down and is connected to the lower frame, wherein at least one of the pair of vertical frames includes an attachment portion projecting from a portion of the at least one of the pair of vertical frames that is below the second expanded portion, and wherein the attachment portion includes a first arm plate extending forward, and a fixing plate connected to a front end of the first arm plate and fixed to the rear surface of the casing.

5. The outdoor unit for an air-conditioning apparatus of claim 4, wherein at least one of the pair of vertical frames includes a correction portion projecting from a portion of the at least one of the pair of vertical frames that is located below the second expanded portion and is different from the portion from which the attachment portion projects, wherein the correction portion includes a second arm plate extending forward, and a contact plate connected to a front end of the second arm plate, and wherein when the fixing plate of the attachment portion is fixed to the rear surface of the casing, a pressing force is applied from the contact plate to the rear surface of the casing.

6. The outdoor unit for an air-conditioning apparatus of claim 4, wherein the casing includes a bottom plate defining a bottom surface of the casing and having a rectangular shape in plan view, wherein the bottom plate includes a bottom flange bent upward at a periphery of the bottom plate, wherein the lower frame includes a correction projection located on a rear side of a rear bottom flange, spaced from the rear bottom flange in the front-rear direction, and projecting forward, the rear bottom flange being a rear portion of the bottom flange, and wherein when the fixing plate of the attachment portion is fixed to the rear surface of the casing, a pressing force is applied from the correction projection to the rear bottom flange.

7. The outdoor unit for an air-conditioning apparatus of claim 1, wherein the casing includes a bottom plate defining a bottom surface of the casing and having a lower surface to which a leg is fixed, wherein the leg extends across the bottom plate in the front-rear direction, and wherein the lower frame includes a forward clearance portion located above the leg, extending across the leg in a lateral direction, and partly projecting forward.

8. The outdoor unit for an air-conditioning apparatus of claim 1, wherein the casing includes a bottom plate defining a bottom surface of the casing and having a lower surface to which a leg is fixed, wherein the leg extends across the bottom plate in the front-rear direction, and wherein the lower frame includes an upward shifted portion located above the leg, extending across the leg in a lateral direction, and partly shifted upward.

9. The outdoor unit for an air-conditioning apparatus of claim 1, wherein each of the plurality of horizontal bars has a V-shape, with a concave surface configured to face the outdoor heat exchanger in vertical cross-section.

* * * * *